US009522343B2

(12) United States Patent
Liu et al.

(10) Patent No.: US 9,522,343 B2
(45) Date of Patent: Dec. 20, 2016

(54) ELECTRONIC DEVICE FOR PRESENTING PERCEIVABLE CONTENT

(71) Applicant: Industrial Technology Research Institute, Hsinchu (TW)

(72) Inventors: Chih-Yuan Liu, Hsinchu County (TW); Chien-Hong Lin, Hsinchu County (TW); Tsung-Hsien Chen, Kaohsiung (TW); Yu-Sheng Li, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/583,776

(22) Filed: Dec. 29, 2014

(65) Prior Publication Data

US 2015/0343321 A1 Dec. 3, 2015

(30) Foreign Application Priority Data

May 30, 2014 (TW) ..... 103119058 A

(51) Int. Cl.
*A63H 30/00* (2006.01)
*A63H 33/26* (2006.01)

(52) U.S. Cl.
CPC ..... *A63H 33/26* (2013.01)

(58) Field of Classification Search
USPC .. 446/91, 175, 297, 397, 484, 491; 273/161; 434/308, 319
See application file for complete search history.

(56) References Cited

U.S. PATENT DOCUMENTS

| | | | | |
|---|---|---|---|---|
| 4,054,286 | A | 10/1977 | Dressler, Sr. | |
| 4,765,623 | A | 8/1988 | Cardillo et al. | |
| 5,191,615 | A * | 3/1993 | Aldava | A63H 3/28 348/485 |
| 5,442,869 | A | 8/1995 | McDarren et al. | |
| 5,482,277 | A | 1/1996 | Young | |
| 6,264,521 | B1 * | 7/2001 | Hernandez | H04N 7/185 348/151 |
| 6,273,421 | B1 | 8/2001 | Thalheimer et al. | |
| 6,449,887 | B1 * | 9/2002 | Song | A63J 17/00 40/406 |

(Continued)

FOREIGN PATENT DOCUMENTS

| | | |
|---|---|---|
| CH | 698396 | 7/2009 |
| CN | 2524327 | 12/2002 |

(Continued)

OTHER PUBLICATIONS

Visser et al, "SnowGlobe: the development of a prototype awareness system for longitudinal field studies," Proceedings of the 8th ACM Conference on Designing Interactive Systems, 2010, pp. 426-429.

(Continued)

*Primary Examiner* — Kurt Fernstrom
(74) *Attorney, Agent, or Firm* — Jianq Chyun IP Office

(57) ABSTRACT

An electronic device for presenting perceivable content(s) is provided. The electronic device includes a presentation unit, a control unit and an operating unit. The operating unit is electrically coupled to the control unit. According to the control of the control unit, the operating unit can present the perceivable content and communicate with an external electronic device.

33 Claims, 22 Drawing Sheets

(56) References Cited

U.S. PATENT DOCUMENTS

| | | | | |
|---|---|---|---|---|
| 6,558,225 | B1 * | 5/2003 | Rehkemper | A63H 3/003 40/448 |
| 6,720,956 | B1 | 4/2004 | Honma et al. | |
| 7,430,823 | B1 | 10/2008 | Chung | |
| 7,568,963 | B1 * | 8/2009 | Atsmon | A63H 3/28 446/175 |
| 7,637,794 | B2 | 12/2009 | Barri et al. | |
| 7,988,519 | B2 * | 8/2011 | Eckerman | A63H 17/395 446/175 |
| 8,044,975 | B2 | 10/2011 | Kim et al. | |
| 8,496,345 | B2 | 7/2013 | Chan | |
| 8,628,223 | B2 | 1/2014 | Kwok et al. | |
| 8,662,954 | B2 * | 3/2014 | Goff | A63H 3/00 396/479 |
| 2001/0051488 | A1 * | 12/2001 | Tachau | A63H 17/34 446/397 |
| 2007/0207700 | A1 | 9/2007 | Ellis | |
| 2007/0287477 | A1 | 12/2007 | Tran | |
| 2008/0172498 | A1 | 7/2008 | Boucard | |
| 2008/0287033 | A1 * | 11/2008 | Steinberg | A63H 3/28 446/297 |
| 2009/0117819 | A1 * | 5/2009 | Nakamura | A63H 3/28 446/297 |
| 2009/0197504 | A1 * | 8/2009 | Hsu | A63H 3/28 446/301 |
| 2010/0149094 | A1 | 6/2010 | Barnes et al. | |
| 2010/0173561 | A1 * | 7/2010 | Tseng | G09F 19/02 446/267 |
| 2011/0294397 | A1 | 12/2011 | Tsai | |
| 2011/0305498 | A1 | 12/2011 | De La Rosa | |
| 2015/0336016 | A1 * | 11/2015 | Chaturvedi | A63H 30/04 446/484 |

FOREIGN PATENT DOCUMENTS

| | | |
|---|---|---|
| CN | 202111894 | 1/2012 |
| CN | 202271761 | 6/2012 |
| CN | 202427172 | 9/2012 |
| CN | 103412708 | 11/2013 |
| DE | 202008009348 | 9/2008 |
| DE | 202009015807 | 2/2010 |
| DE | 202009007621 | 9/2010 |
| TW | 133078 | 4/1990 |
| TW | 200998 | 2/1993 |
| TW | 232158 | 10/1994 |
| TW | M328897 | 3/2008 |
| TW | M366119 | 10/2009 |

OTHER PUBLICATIONS

Benko et al., "Sphere: Multi-Touch Interactions on a Spherical Display," Proceedings of the 21st annual ACM symposium on User interface software and technology, 2008, pp. 77-86.

Sahni et al., "Beyond the Crystal Ball: Locational Marginal Price Forecasting and Predictive Operations in U.S. Power Markets," Power and Energy Magazine, IEEE, 2012, pp. 35-42.

Visser et al, "Designing to Support Social Connectedness: The Case of SnowGlobe," International Journal of Design, 2011, pp. 129-142.

Yi-Chu Lin et al, "An Implicit Change: Designing Poetic Experience in Daily Practice," Journal of Design, Mar. 2013, pp. 25-39.

Bolton et al., "SnowGlobe: a spherical fish-tank VR display," CHI '11 Extended Abstracts on Human Factors in Computing Systems, May 7-12, 2011, pp. 1159-1164.

Yamaha, "InfoSound, " Yamaha Corporation Annual Report, 2011, pp. 36-37.

Lopes et al, "Aerial acoustic communications", IEEE Workshop on Applications of Signal Processing to Audio and Acoustics, Oct. 21-24, 2001, pp. 219-222.

"Office Action of Taiwan Counterpart Application", issued on Mar. 4, 2016, p. 1-7, in which the listed references were cited.

* cited by examiner shift 2/256 beat, binary code 10
shift 1/256 beat, binary code 01
no shift, binary code 00
shift −1/256 beat, binary code 11

P
PW

1/2P

1/4P
1/4P

1/8P
1/8P
1/8P
1/8P

1/8P
1/2P

100

ELECTRONIC DEVICE FOR PRESENTING PERCEIVABLE CONTENT

CROSS-REFERENCE TO RELATED APPLICATION

This application claims the priority benefit of Taiwan application serial no. 103119058, filed on May 30, 2014. The entirety of the above-mentioned patent application is hereby incorporated by reference herein and made a part of this specification.

TECHNICAL FIELD

The disclosure relates to an electronic device for presenting perceivable content.

BACKGROUND

Crystal balls (water globes, or snow globes) or models are generally used as ornaments. Some of the crystal balls or the models are capable of providing sounds and lights for audiovisual effects, while some others are capable of providing simple interactive functions. However, the crystal balls or the models usually operate in a stand-alone manner, and the provided audiovisual effects are not related to operations of external electronic devices.

SUMMARY

According to the embodiments of the disclosure, an electronic device for presenting perceivable content is provided, which includes a presentation unit, a control unit and an operating unit. The operating unit is electrically coupled to the control unit. The operating unit is disposed to present the perceivable content on the presentation unit according to a control of the control unit, and communicate with an external electronic device by a manner of sound or light.

According to the embodiments of the disclosure, an electronic device for presenting perceivable content is provided, which is adapted to perform at least one of an instrumental ensemble, a chorus and a dance together with an external electronic device. This electronic device for presenting perceivable content includes a control unit, an operating unit and a communication unit. The operating unit is electrically coupled to the control unit. The operating unit is disposed to present the perceivable content by a sound under a control of the control unit. The communication module is electrically coupled to the control unit. The communication module has a wireless communication capability for communicating with the external electronic device.

Several exemplary embodiments accompanied with drawings are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION

Figure 1A:
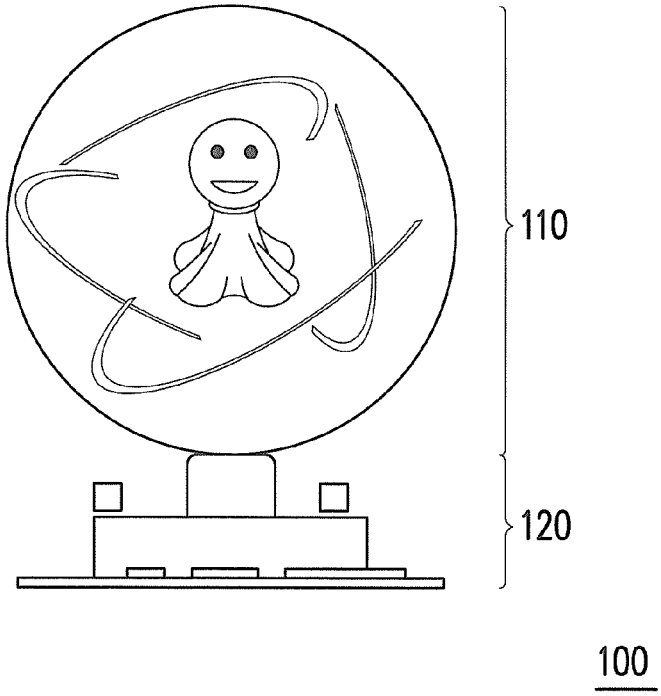
FIG. 1A is a schematic diagram illustrating an electronic device for presenting perceivable content according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The term "coupling/coupled" used in this specification (including claims) may refer to any direct or indirect connection means. For example, "a first device is coupled to a second device" should be interpreted as "the first device is directly connected to the second device" or "the first device is indirectly connected to the second device through other devices or connection means." Moreover, wherever appropriate in the drawings and embodiments, elements/components/steps with the same reference numerals represent the same or similar parts. Elements/components/steps with the same reference numerals or names in different embodiments may be cross-referenced.

FIG. 1A is a schematic diagram illustrating an electronic device 100 for presenting perceivable content according to an embodiment of the disclosure. The perceivable content is, for example, content noticeable by human or any animal. A shape of the electronic device 100 for presenting perceivable content may be a sphere shape, a musical instrument shape, a music box shape or other geometrical features. The electronic device 100 includes a presentation unit 110 and a base 120. The presentation unit 110 is disposed on the base 120. In another embodiment, the presentation unit 110 is disposed under the base 120. In another embodiment, the presentation unit 110 and the base 120 are substantially in contact, but the disclosure is not limited thereto. In the embodiment depicted in FIG. 1A, the presentation unit 110 may be a sphere shape, a musical instrument shape, a music box shape or other geometrical features, or may also be an open space. A model, a musical instrument, a music box, a doll, a toy or other shapes may be disposed in the open space. In other embodiments, the presentation unit 110 includes a transparent space, and the transparent space may be a crystal ball, a water ball, an air ball or other transparent/translucent spaces. The electronic device 100 may be applied in an interactive ball device or electronic devices of other shapes, such as interactive crystal balls (water globes, or snow globes), or interactive devices, interactive objects, interactive musical instruments, and so on. A communication may be conducted between a plurality of the electronic devices 100 in a manner of sound or light, so as to present a variety of the perceivable content in the manner of sound or light. The perceivable content may be content that human may notice or feel, such as a content which may be seen, heard, smelled or touched by human. The perceivable content is, for example, a sound, a light, a smell, an action, or a combination of two or more of the above. The sound is, for example, a sound that may be heard by humans or animals. The light is, for example, a visible light, or a light that may be seen by animals. The perceivable content may also be, for example, entertainment content such as music, an animation or an audiovisual effect, but the disclosure is not limited thereto.

Figure 1B:
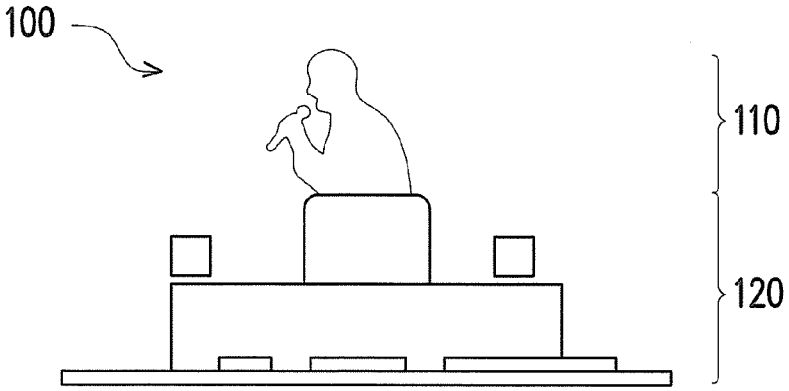
FIG. 1B is a schematic diagram illustrating an electronic device for presenting perceivable content according to another embodiment of the disclosure.

FIG. 1B is a schematic diagram illustrating an electronic device 100 for presenting perceivable content according to another embodiment of the disclosure. The electronic device 100 depicted in FIG. 1B may be inferred by reference with related description for FIG. 1A. In the embodiment depicted in FIG. 1B, the shape of the presentation unit 110 may be a non-sphere such as a singer doll shape.

Figure 2:
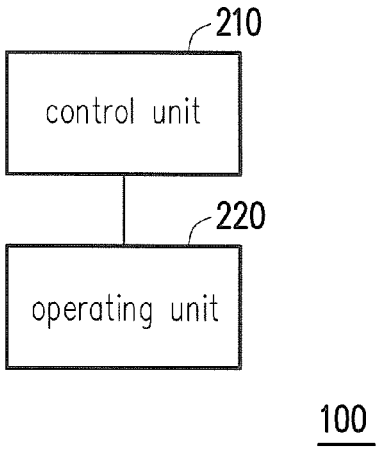
FIG. 2 is block diagram illustrating circuitry of the electronic devices depicted in FIG. 1A or FIG. 1B.

FIG. 2 is a block diagram illustrating circuitry of the electronic devices 100 depicted in FIG. 1A or FIG. 1B according to an embodiment of the disclosure. The electronic device 100 includes a control unit 210 and an operating unit 220. In some embodiments, the control unit 210 and/or the operating unit 220 may be disposed inside the base 120. In some other embodiments, a part of components in the control unit 210 and/or the operating unit 220 may be disposed inside the base 120, while the remaining components may be disposed outside the base 120 (e.g. disposed in the sphere of the interactive crystal ball). In other embodiments, the control unit 210 and/or the operating unit 220 may be disposed entirely outside the base 120.

The operating unit 220 is electrically coupled to the control unit 210. According to a control of the control unit 210, the operating unit 220 may present the perceivable content on the presentation unit 110 in the manner of sound or light, and communicate with one or more external electronic devices in the manner of sound or light or by a radio frequency signal. The external electronic device may be another electronic device having functions similar to those of the electronic device 100, a cell phone, a microprocessor, a computer, a notebook computer, a tablet computer, a server or other interactive devices, or any combination of the above, but the disclosure is not limited thereto. The control unit 210 may transmit data to the external electronic device or receive an external signal or an external data from the external electronic device via the operating unit 220. The data/the external signal/the external data may include music data, light displaying data, a command, a script or other information. The control unit 210 may process the external data received by the operating unit 220, and determine settings for the control of the electronic device 100 (e.g. setting or determining the perceivable content, or change behavior modes) according to the external signal. In some embodiments, the electronic device 100 is capable of identifying whether there are other devices nearby, so as to decide different interactive behavior modes and the perceivable content. For example, in a stand-alone mode, a solo singing of a specific song is performed. But if there are other devices (e.g. the external electronic devices) nearby, a duet singing or a chorus singing of the song may be performed. If the other devices (e.g. the external electronic devices) nearby do not have related data of the song (e.g. a part of the music), the control unit 210 may transmit related data of the song to the external electronic devices via the operating unit 220 for performing the duet singing or the chorus singing of the song later, and vice versa.

Accordingly, while presenting the perceivable content, the electronic device 100 may perform a data transmission by using a sound wave, a light ray or the radio frequency signal. For example, the operating unit 220 may transmit a sound wave having a synchronous data by a speaker, and the sound wave may be a musical rhythm, or a frequency that cannot be heard by human ear. On the other hand, the operating unit 220 may also obtain an ambient sound (e.g. a sound emitted by the external electronic devices) by a microphone, so as to convert the sound wave into a signal. As another example, the operating unit 220 may transmit a visible light or an invisible light by a lamp, and receive a light signal by an optical sensing element. The optical sensing element is, for example, a photo sensor and so on. The lamp may be a light-emitting diode (LED) or other light sources. In addition, among many amount combinations of the electronic device 100 or the external electronic devices, one of the devices may be pre-designated or dynamically decided to be a master device while the others are slave devices. The master device may transmit the synchronous data via the operating unit 220 to indicate synchronous methods, such as a timestamp, a beacon, a paragraph, a note, a starting trigger, or an ending trigger. The slave devices may adopt a non-reliable mode in which an acknowledge is not replied to the master device, and thus maybe a reliability and a succession of the communication is not ensured. Alternatively, the slave devices may adopt a reliable mode in which the acknowledge is replied to the master device via the operating unit 220, so as to ensure the reliability and the succession of the communication. Therefore, the master device and the slave devices may collaboratively present various perceivable contents. In some other exemplary embodiments, other slave devices may join in the middle of collaboratively presenting the contents. For example, an electronic device for playing a flute section may join in the middle of a symphony performed by an orchestra. In one embodiment, once activated, the electronic device for playing flute section receives the synchronous data transmitted by the master device via the operating unit 220, and starts to play the corresponding timestamp, the beacon, the paragraph or the note in the synchronous data according to the starting trigger in the synchronous data, so as to accurately and synchronously play the flute section of the symphony. In another embodiment, once activated, a request is transmitted to the master device via the operating unit 220 to request the master device to provide the synchronous data, so as to start playing the perceivable content corresponding to the synchronous data.

When a stand-alone mode is entered, the electronic device 100 for presenting perceivable content presents the perceivable content in a stand-alone manner. When the stand-alone mode is not entered, the electronic device 100 for presenting perceivable content performs at least one of an instrumental ensemble, a chorus and a dance (e.g. circling, swing, grooving and so on, but the disclosure is not limited thereto) together with the external electronic device in a master-slave architecture. A synchronization or communication may be performed between the electronic device 100 and the external electronic device by adopting the reliable mode or the non-reliable mode. Two of the electronic device 100 and the external electronic device may include one being the master device and another one being the slave device, which are pre-designated or dynamically decided.

Figure 3:
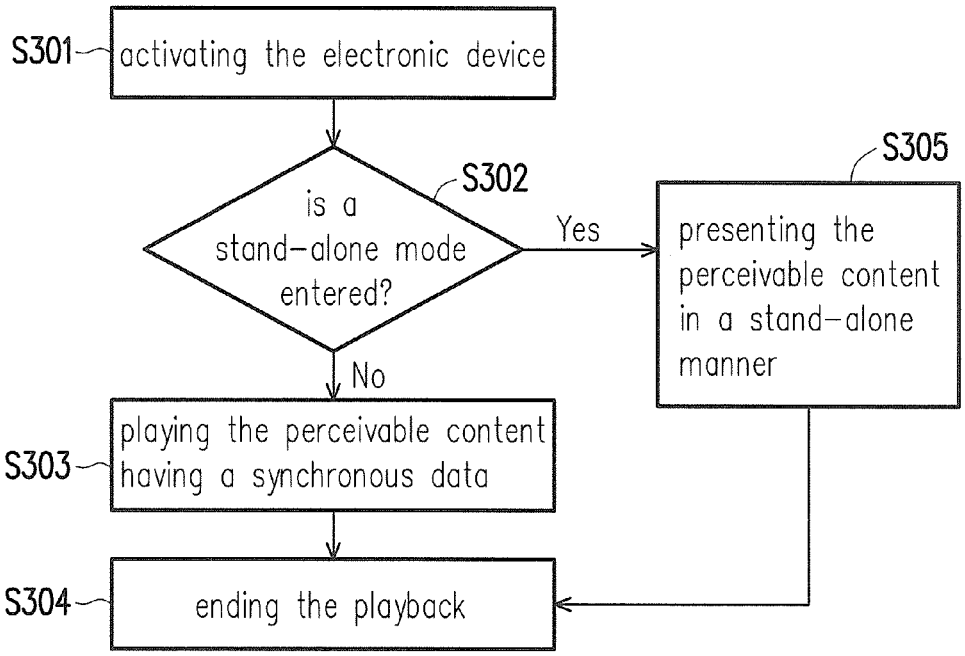
FIG. 3 is a flowchart illustrating a synchronization behavior of the master device in the non-reliable mode according to an embodiment of the disclosure.

FIG. 3 is a flowchart illustrating a synchronization behavior of the master device in the non-reliable mode according to an embodiment of the disclosure. In this embodiment, the electronic device 100 is configured as the master device. In step S301, the electronic device 100 is activated. The methods to activate the electronic device 100, for example, is to turn on the power by triggering a sensor or pressing a power switch. Once activated, the electronic device 100 proceeds to step S302. In step S302, whether to enter a stand-alone mode is determined by default factory settings in the electronic device 100 or by operations of the operating unit 220. If the stand-alone mode is entered, the electronic device 100 proceeds to step S305 to present perceivable content in a stand-alone manner. If the stand-alone mode is not entered, the electronic device 100 proceeds to step S303. In step S303, the control unit 210 transmits the perceivable content with synchronous data via the operating unit 220. A transmission of the synchronous data may be of an one-time transmission. In some other embodiments, the synchronous data may be transmitted multiple times until a playback of the content ends. Lastly, the electronic device 100 proceeds to step S304 when the presentation ends.

Figure 4:
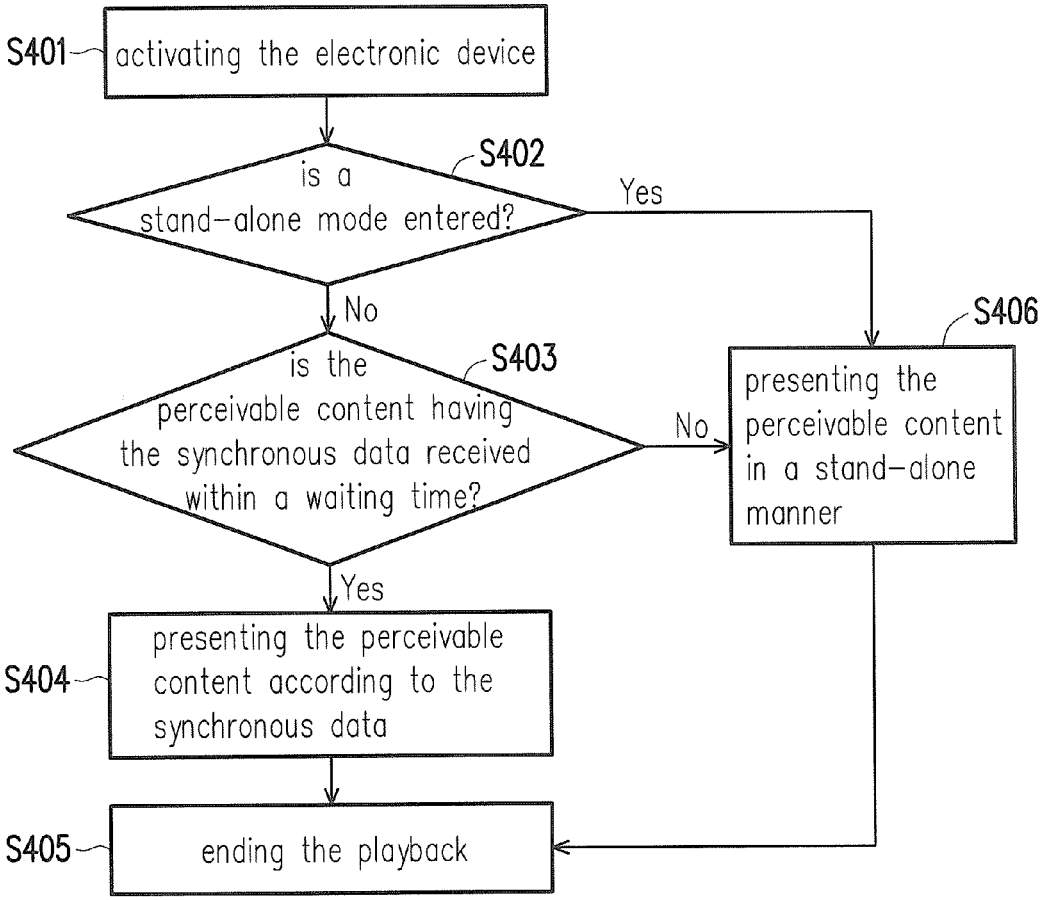
FIG. 4 is a flowchart illustrating a behavior of the slave device in the non-reliable mode according to an embodiment of the disclosure.

FIG. 4 is a flowchart illustrating a behavior of the slave device in the non-reliable mode according to an embodiment of the disclosure. In this embodiment, the electronic device 100 is configured as the slave device. In step S401, the electronic device 100 is activated. The methods to activate the electronic device 100, for example, is to turn on the power by triggering a sensor or pressing a power switch. Once activated, the electronic device 100 proceeds to step S402. In step S402, whether to enter a stand-alone mode is determined by default factory settings in the electronic device 100 or by operations of the operating unit 220. If the stand-alone mode is entered, the electronic device 100 proceeds to step S406 to present perceivable content in a stand-alone manner. If the stand-alone mode is not entered, the electronic device 100 proceeds to step S403. In step S403, the electronic device 100 obtains a state of the operating unit 220 to examine whether the perceivable content with synchronous data from an external electronic device, which is master device in this embodiment, is received within a waiting time. The control unit 210 examines whether the synchronous data is received for determining a method to trigger the presenting of the entertainment content. If the synchronous data is received by the operating unit 220 within the waiting time, the control unit 210 presents the perceivable content according to the synchronous data in step S404, so as to collaboratively present the perceivable content together with the master device. If the synchronous data from the master device is not received, the slave device proceeds to step S406 to present the entertainment content in the stand-alone manner. The slave device proceeds to step S405 when the presentation ends.

Figure 5:
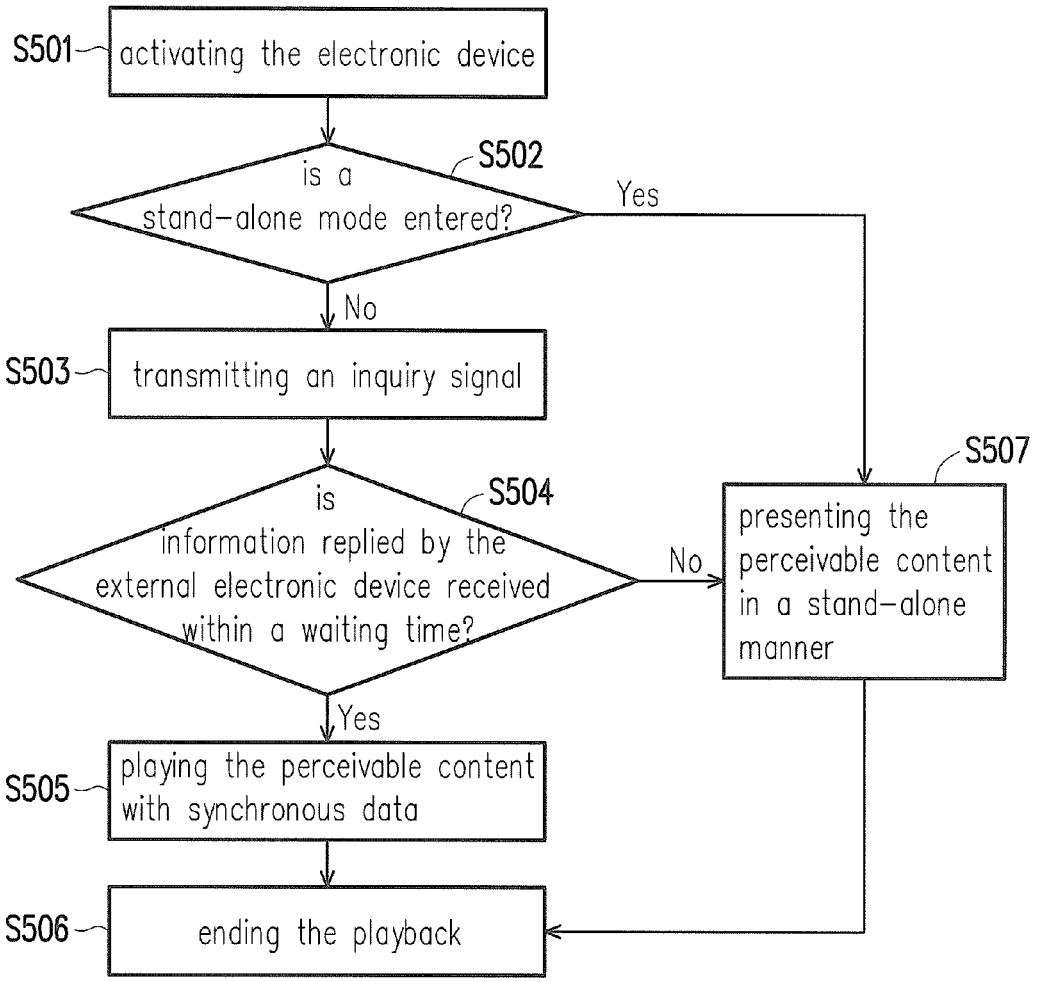
FIG. 5 is a flowchart illustrating a synchronization behavior of the master device in the reliable mode according to an embodiment of the disclosure.

FIG. 5 is a flowchart illustrating a synchronization behavior of the master device in the reliable mode according to an embodiment of the disclosure. In this embodiment, the electronic device 100 is configured as the master device. In step S501, the electronic device 100 is activated. The methods to activate the electronic device 100, for example, is to turn on the power by triggering a sensor or pressing a power switch. Once activated, the electronic device 100 proceeds to step S502. In step S502, whether to enter a stand-alone mode is determined by default factory settings in the electronic device 100 or by operations of the operating unit 220. If the stand-alone mode is entered, the electronic device 100 proceeds to step S507 to present perceivable content in a stand-alone manner. If the stand-alone mode is not entered, the electronic device 100 proceeds to step S503 where an inquiry signal is transmitted via the operating unit 220 to obtain information of the external electronic device, which is slave device in this embodiment, within a communication range. Next, the electronic device 100 proceeds to step S504 to wait for the external electronic device replying the information within a waiting time. If no response is received from the external electronic device within the waiting time, the master device proceeds to step S507 to present perceivable content in a stand-alone manner. If the response is received from the external electronic device within the waiting time, the electronic device 100 proceeds to step S505. In step S505, the control unit 210 of the electronic device 100 transmits the perceivable content with synchronous data via the operating unit 220. A transmission of the synchronous data may be of an one-time transmission. In some other embodiments, the synchronous data may be transmitted multiple times until a playback of the content ends. Lastly, the electronic device 100 proceeds to step S506 when the presentation ends.

Figure 6:
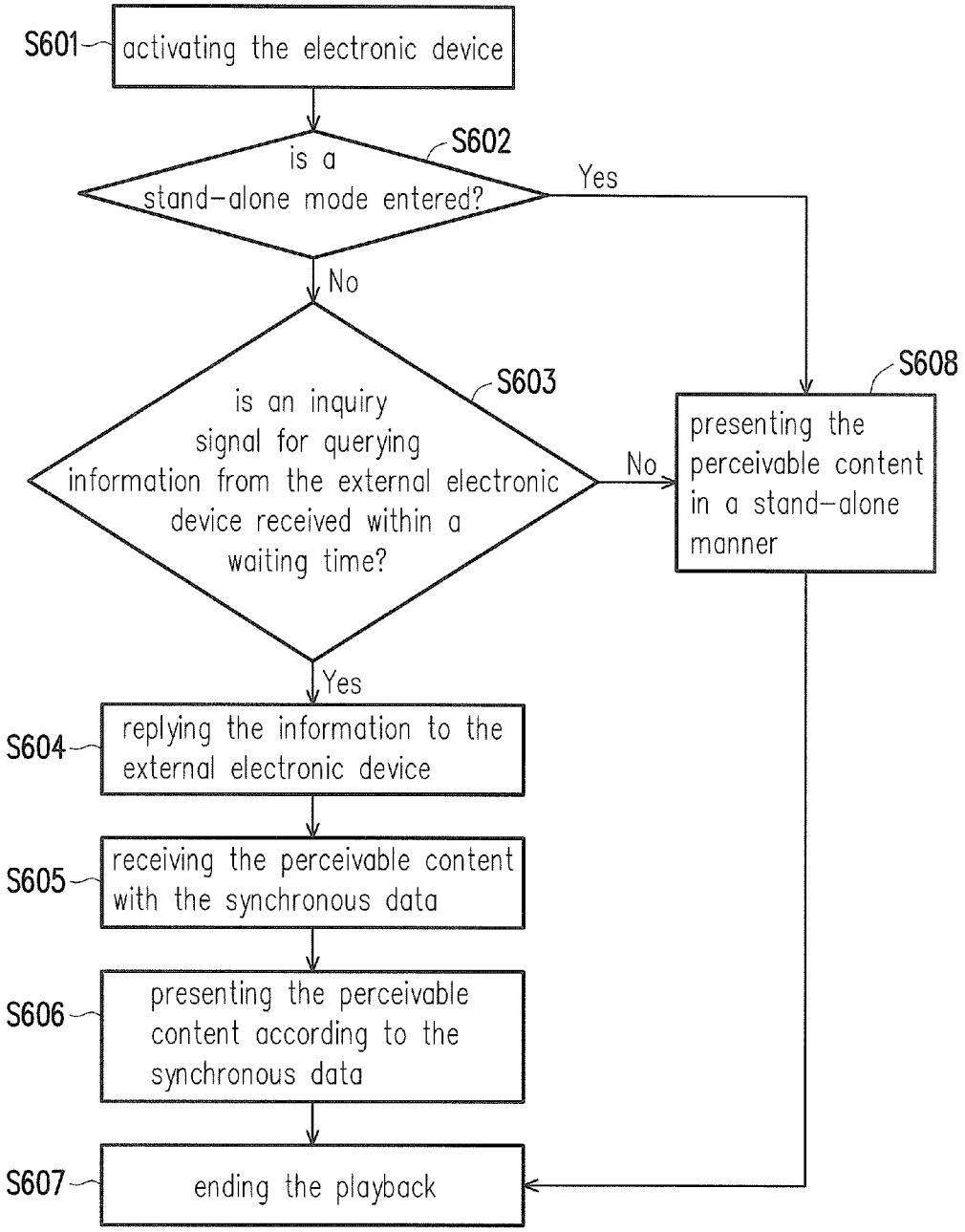
FIG. 6 is a flowchart illustrating a behavior of the slave device in the reliable mode according to an embodiment of the disclosure.

FIG. 6 is a flowchart illustrating a behavior of the slave device in the reliable mode according to an embodiment of the disclosure. In this embodiment, the electronic device 100 is configured as the slave device. In step S601, the electronic device 100 is activated. The methods to activate the electronic device 100, for example, is to turn on the power by triggering a sensor or pressing a power switch. Once activated, the electronic device 100 proceeds to step S602. In step S602, whether to enter a stand-alone mode is determined by default factory settings of the electronic device 100 or by operations of the operating unit 220. If the stand-alone mode is entered, the electronic device 100 proceeds to step S608 to present perceivable content in a stand-alone manner. If the stand-alone mode is not entered, the electronic device 100 proceeds to step S603. In step S603, the electronic device 100 obtains a state of the operating unit 220 to examine whether an inquiry signal from the external electronic device, which is master device in this embodiment, for querying information of the electronic device 100 is received by the operating unit 220 within a waiting time. The electronic device 100 examines whether the inquiry signal from the external electronic device is received. If the inquiry signal is received by the operating unit 220 of the electronic device 100, the control unit 210 of the electronic device 100 replies a response with the information of the electronic device 100 to the external electronic device via the operating unit 220 in step S604, and proceeds to step S605 for receiving the perceivable content with synchronous data from the external electronic device. If the perceivable content with the synchronous data from the external electronic device is received by the operating unit 220 of the electronic device 100, the electronic device 100 may present the perceivable content according to the synchronous data in step S606. The electronic device 100 and the external electronic device may collaboratively present the perceivable content such as the instrumental ensemble or the chorus. If the inquiry signal from the external electronic device is not received in step S603, the electronic device 100 proceeds to step S608 to present the entertainment content in the stand-alone manner. The electronic device 100 proceeds to step S607 after a presentation time ends.

In one embodiment, the synchronous data may include information of the starting trigger, such that the slave devices in the communication range of the master device may be triggered to collaboratively present the perceivable content. For example, after the synchronous data having the information of the starting trigger is transmitted by a master ballet dancer (the master device), other ballet dancers (the slave devices) in the communication range may start to dance or circle. In one embodiment, the synchronous data may include data having a number of a designated music and/or a designated lighting pattern. For example, after the number of the designated music is transmitted by the a symphony conductor (the master device), various musical instruments (the slave devices) within the communication range may select the music according to the number and start to play under command of the conductor. As another example, after the number of the designated lighting pattern is transmitted by a Santa Claus (the master device), Christmas trees and Christmas gifts (the slave devices) within the communication range may present a performance according to the number of the designated lighting type under the command of the Santa Claus.

In addition, a transmission of the synchronous data may be of an one-time transmission or a multiple-times transmission. In one embodiment, the master device may indicate various synchronization methods and transmit the timestamp, the beacon, the paragraph, the note, the starting trigger, or the ending trigger and so on via the operating unit 220 continuously. For example, the device that join in the middle may obtain the timestamp, the beacon, the paragraph, the note or an elapsed time of the performance being played, so as to collaboratively join the presentation of the entertainment content. Further, because transmission distances of the sound, the light and the radio frequency signal are controllable, strengths thereof may be adjusted accordingly in response to different situations for various applications. In one embodiment, a one-to-one communication may be performed based on aforesaid communication methods to present the perceivable content (e.g. a duet singing by a couple). In another embodiment, a multicast communication may be performed to present the perceivable content such as a symphony concert, conducting by a bandleader, an instrumental ensemble of subdivisions, various dances, or various singings. Further, the sound and the light may have a characteristic of directive property under certain situations or influenced by the placement of the operating unit 220. For example, for the duet singing by a couple, the couple faces each other before the singing may begin. It may be similar for other situations.

Figure 7:
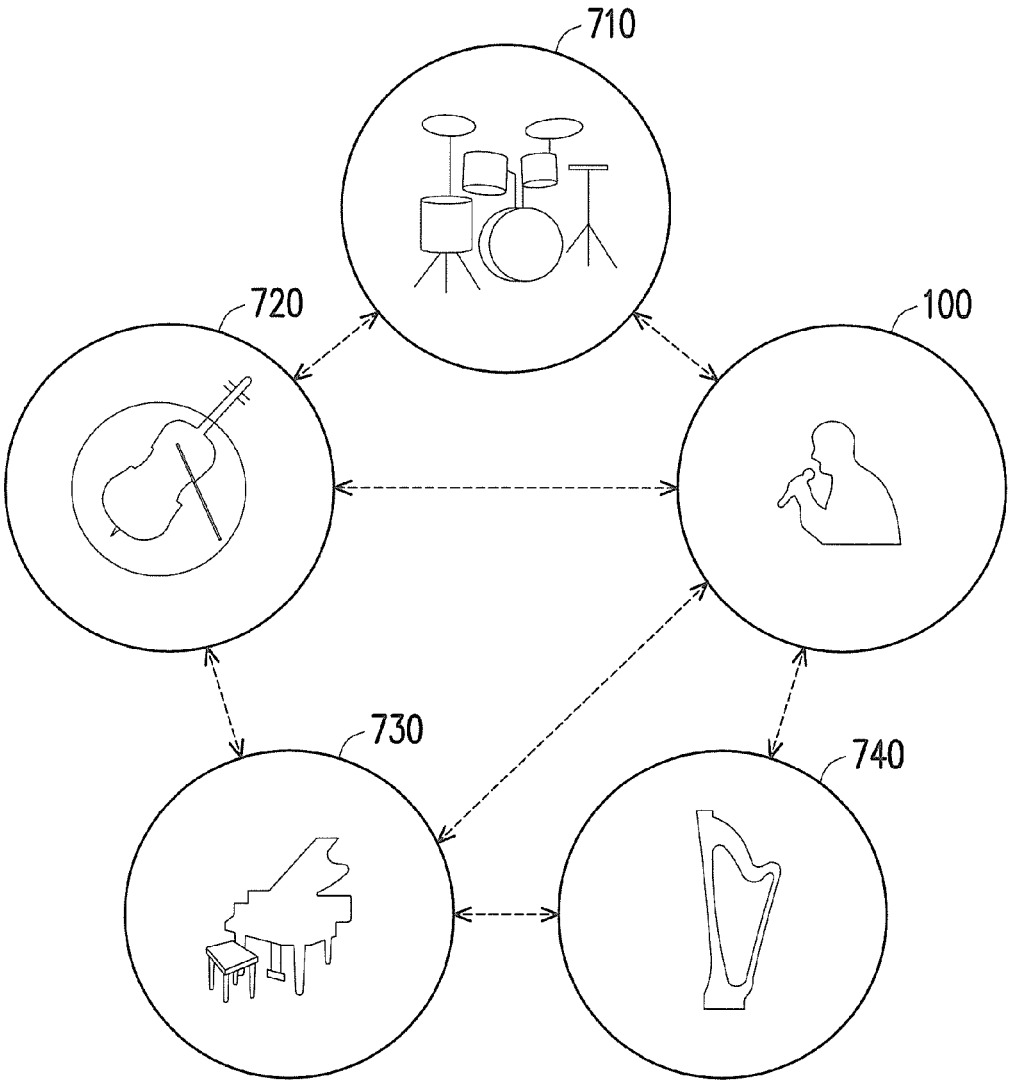
FIG. 7 is schematic diagram illustrating a situation where a plurality of electronic devices are performing the instrumental ensemble according to an embodiment of the disclosure.

In one embodiment, the operating unit 220 may communicate with the external electronic device by adopting an "obvious data transmission" method. The "obvious data transmission" method means that the transmission of the information/signal is noticeable by human. For example, the operating unit 220 may transmit the information/signal to be transmitted by the electronic device 100 to the external electronic device by using a rhythm and a melody of the music, a flickering, or an intensity or a color of the lighting. The external electronic device may decode the information/signal transmitted by the operating unit 220 for various applications. For example, FIG. 7 is schematic diagram illustrating a situation where a plurality of electronic devices are performing the instrumental ensemble according to an embodiment of the disclosure. Implementation details regarding electronic devices 710, 720, 730 and 740 may be inferred by reference with related description for the electronic device 100. The electronic devices 100, 710, 720, 730 and 740 may collaboratively communicate with each other in a manner of sound or light.

When the operating unit 220 of the electronic device 100 is presenting the perceivable content, the operating unit 220 of the electronic device 100 may transmit the rhythm of the music to the other electronic devices 710, 720, 730 and 740 (the external electronic devices) in the manner of lamp/light which is noticeable by human. For example, the rhythm and the melody of the music may serve as the information to be transmitted. Alternatively, the electronic device 100 may transmit the rhythm of the music to the other electronic devices 710, 720, 730 and 740 by using variations in the flickering, the intensity or the color of the lighting. The electronic devices 710, 720, 730 and 740 may synchronously perform the instrumental ensemble according to the rhythm of a music played by the electronic device 100. For example, the electronic device 100 may play a voice of singer; the electronic device 710 may play a sound of percussion or an obvious sound signal such as a DTMF (Dual-Tone Multi-Frequency) sound; the electronic device 720 may play a sound of violin; the electronic device 730 may play a sound of piano; and the electronic device 740 may play a sound of harp. Accordingly, the electronic devices 100, 710, 720, 730 and 740 may collaboratively perform the instrumental ensemble synchronously. The transmission of the signal is not limited to be transmitted by one specific electronic device. In addition, in the application where the synchronous data is used, a signal receiver may enhance the effect of synchronization by adopting a phase locked loop (PLL), such that the signal receiver may still play with current speed and phase in case that the synchronous data is not received.

In some other embodiments, the operating unit 220 may communicate with the external electronic device by adopting a "non-obvious data transmission" method. Unlike the "obvious data transmission" method, the electronic device 100 that performs the communication by the "non-obvious data transmission" method may embed information that is difficult or unable for human to notice in the music/lighting as a method for the electronic device 100 to communicate with the external electronic devices. In other words, the operating unit 220 may embed communication data which is to be transmitted to the external electronic device in a sound or light of the perceivable content, such that the communication data is difficult or unable for human to notice. For example, the operating unit 220 may transmit a data code by using variations of a time shift or a frequency shift of an individual tone (e.g. a note, but the disclosure is not limited thereto) of the sound (e.g. the music, but the disclosure is not limited thereto) content. The time shift or the frequency shift may be a tiny shift that is difficult or unable for human to notice.

Figure 8:
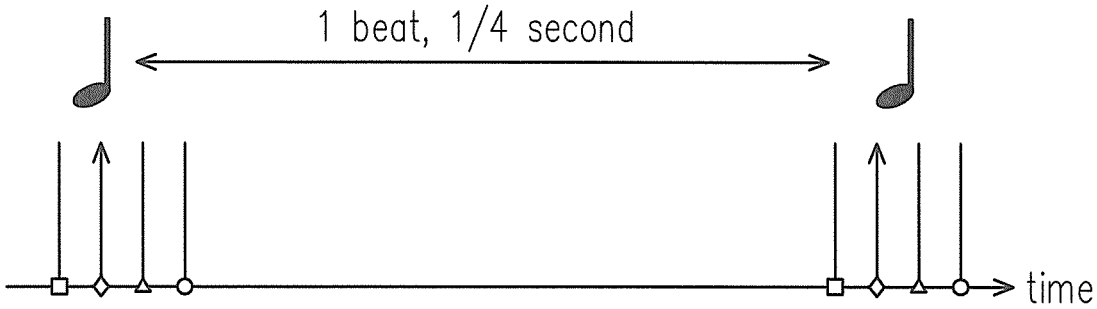
FIG. 8 is a schematic diagram illustrating the transmission of the data code performed by using the variations of the time shift of the individual note in the music content.

In this embodiment, for example, the sound described above is implemented by the music, and the individual tone is implemented by the note. The control unit 210 may correspondingly decide a time shift quantity according to a data code to be transmitted to the external electronic device. According to the time shift quantity, the control unit 210 may control the operating unit 220 to shift a starting-point of one specific tone in a sound content of the perceivable content, and/or shift a light-up starting-point of light of the perceivable content. For instance, FIG. 8 is a schematic diagram illustrating the transmission of the data code performed by using the variations of the time shift of the individual note in the music content according to an embodiment of the disclosure. For an allegro electronic music with a fixed speed, a tempo thereof is fixed to 240 beats per minute, each beat is a 1/4 note, namely, there are four 1/4 notes per second. Normally, a shortest note of a music is a 1/32 note. Accordingly, under a fixed tempo, regardless of whether the note is long or short, a starting point of the note is aligned to grids of the 1/32 note (i.e., 1/8 beat) or a 1/64 note (i.e., 1/16 beat). The operating unit 220 may transmit the data code by performing the time shift of a minimum grid set by the music (e.g. 1/16 beat or 1/32 beat) from the starting point of each note in the music content. For example, shifting by 1/256 beat (i.e., 1/1024 second) is a time shift that is difficult for human to notice. However, the operating unit 220 or the control unit 210 of the crystal ball are capable of detecting that the note is not aligned with the grids of the 1/32 note or the 1/64 note, analyzing the time shift of 1/1024 second from the time grid, and decoding the signal to obtain the information encoded in the signal. For instance, the control unit 210 may respectively map the time shift quantities of the individual notes at −1/256 beat, 0 beat (i.e., no shift), 1/256 beat and 2/256 beat to binary code 11, 00, 01 and 10 as data codes to be transmitted to the external electronic device. In some embodiments, if the crystal ball transmitting the information intends to transmit a 8-bit binary data {b7, b6, b5, b4, b3, b2, b1, b0}, four individual notes may be selected for time-shifting in order to transmit {b7, b6}, {b5, b4}, {b3, b2} and {b1, b0}, respectively.

Figure 9:
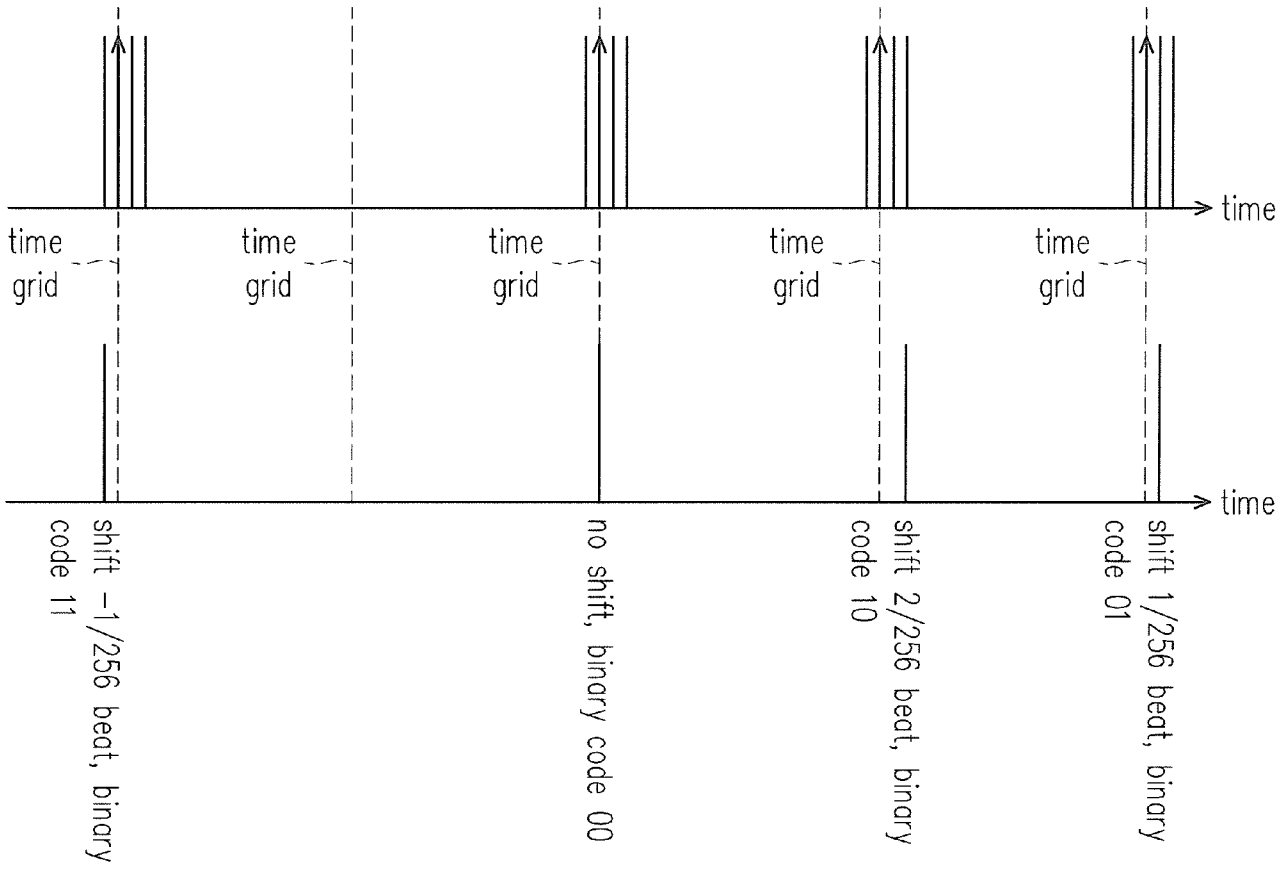
FIG. 9 is a schematic diagram illustrating the transmission of the data code performed by using the variations of the time shift of the individual note in the music content.

FIG. 9 is a schematic diagram illustrating the transmission of the data code performed by using the variations of the time shift of the individual note in the music content according to an embodiment of the disclosure. A dotted line in FIG. 9 refers to a minimum grid as described above. The operating unit 220 may transmit the binary data {1, 1}, {0, 0}, {1, 0} and {0, 1} to the external electronic device by using notes with different length. Said {1, 1}, {0, 0}, {1, 0} and {0, 1} may compose one 8-bit binary data {11001001}.

In the embodiments depicted in FIG. 8 and FIG. 9, the variations which are difficult or unable for human to notice are embedded in the starting point of the note in the music for the electronic device 100 to communicate with the external electronic device, so as to realize the "non-obvious data transmission" method. By analogy, in some other embodiments, the operating unit 220 may flicker a light with a tempo in the perceivable content, and the operating unit 220 may transmit the data code by shifting a time phase shift of a minimum grid of the light-up stating point of the light. The time phase shifts of the flickering light (shifting from the starting point of lighting) are difficult for human to notice but may be sensed by circuits, and the transmitted data may be decoded by circuits.

Figure 10:
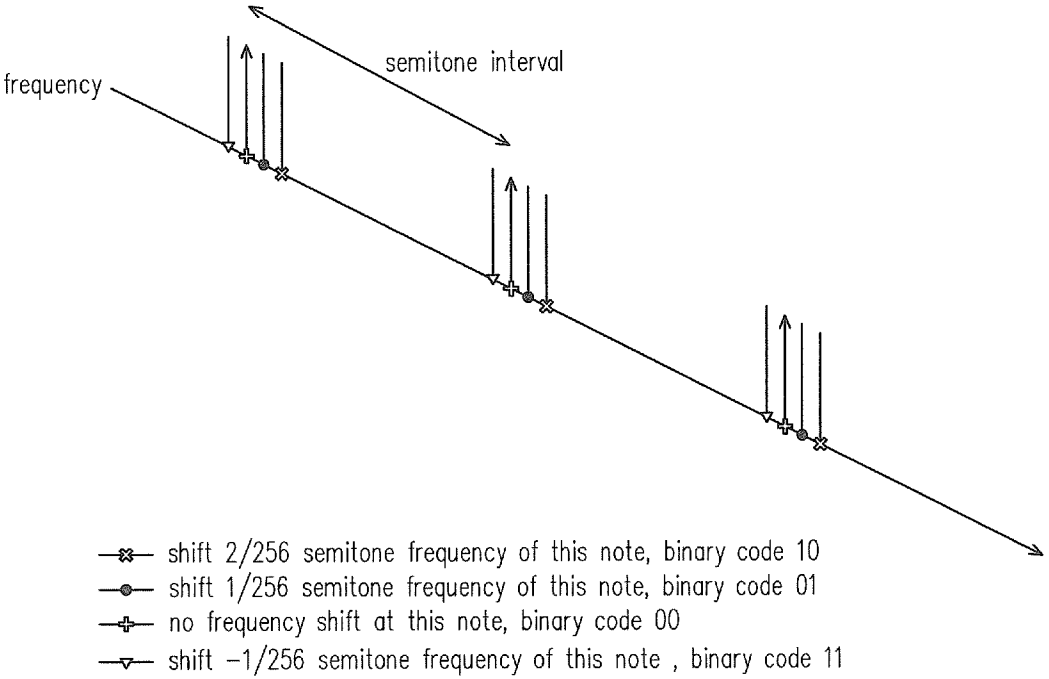
FIG. 10 is a schematic diagram illustrating the transmission of the data code performed by adding the frequency shift or modulation to the note in the music.
Figure 11:
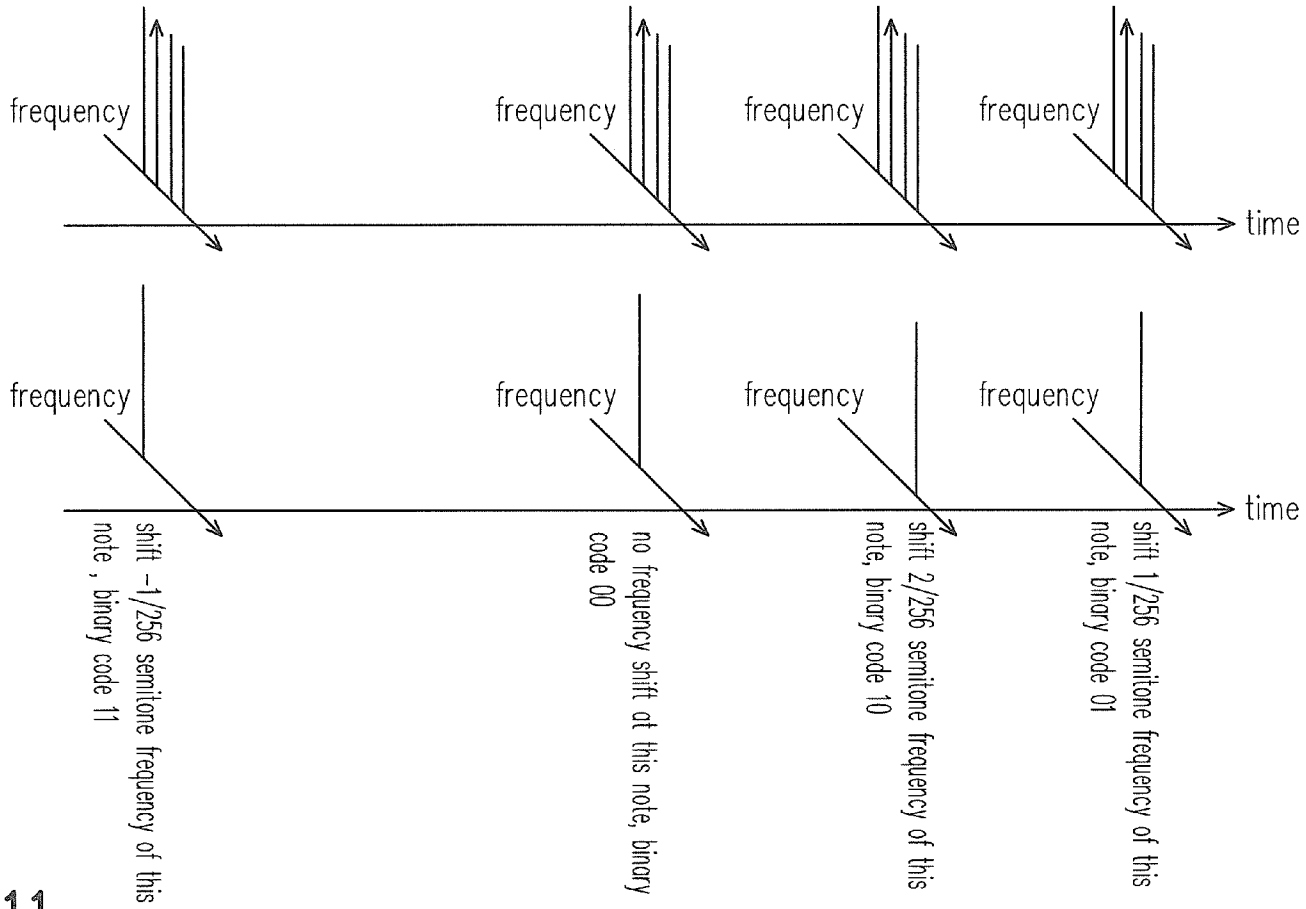
FIG. 11 is a schematic diagram illustrating the transmission of the data code performed by using the frequency shift of the individual note in the music content.

In addition, the operating unit 220 may add a frequency shift or modulation to the note of the music in order to transmit the data code. The tiny frequency variations are difficult for human to notice but may be sensed by circuits, and the transmitted data may be decoded by circuits. The control unit 210 may correspondingly determine a frequency shift quantity according to a data code to be transmitted to the external electronic device. The control unit 210 controls the operating unit 220 to shift a frequency of a note in the music content of the perceivable content according to the frequency shift quantity. For instance, FIG. 10 is a schematic diagram illustrating the transmission of the data code performed by adding the frequency shift or modulation to the note of the music according to an embodiment of the disclosure. In general music, a minimum musical interval between pitches of two notes is a semitone. Usually, a ratio between frequencies of semitones is $(2)^{1/12}$ (a $(1/12)^{th}$ power of 2, which is approximately 1.059463094359). That is, in two adjacent notes being the semitone, the frequency of a higher note is $2^{1/12}$ times of the frequency of a lower note. The operating unit 220 may use the frequency shift less than the semitone to transmit the data code. The tiny frequency variations are difficult for human to notice but may be measured by circuits. FIG. 11 is a schematic diagram illustrating the transmission of the data code performed by using the frequency shift of the individual note in the music content according to an embodiment of the disclosure. In the embodiment depicted in FIG. 11, the operating unit 220 uses four note frequencies having the frequency shift quantities to respectively transmit data codes {1, 1}, {0, 0}, {1, 0} and {0, 1} (bit data) to the external electronic device.

As another example, the operating unit 220 may use a class-D amplifier to drive the speaker to play the music, and the class-D amplifier may generate an analog output by a pulse-width modulation (PWM) in order to drive the speaker. By selecting different modulation methods for a pulse-width, the operating unit 220 may decide a total pulse-width of a sound or light within a period according to the perceivable content. Different phases and/or different number of pulses may be selected for the same total pulse-width. The operating unit 220 may decide the number of pulses and/or the pulse phase within the period according to the communication data to be transmitted to the external electronic device. As another example, the operating unit 220 may add high-frequency brightness variations which are difficult for human to notice into a light flickering rhythm, so as to transmit the data code by using phase modulation or frequency modulation. Or, the data may also be transmitted by using an infrared ray or an ultrasonic wave which are unable for human to notice. Further, as the general communication systems, redundancy data (e.g. various error correction codes) may be added in the data to be transmitted in order to prevent noise interference or poor reception, and to increase a correctness of the data transmission.

Figures 12A, 12B, 12C, 12D:
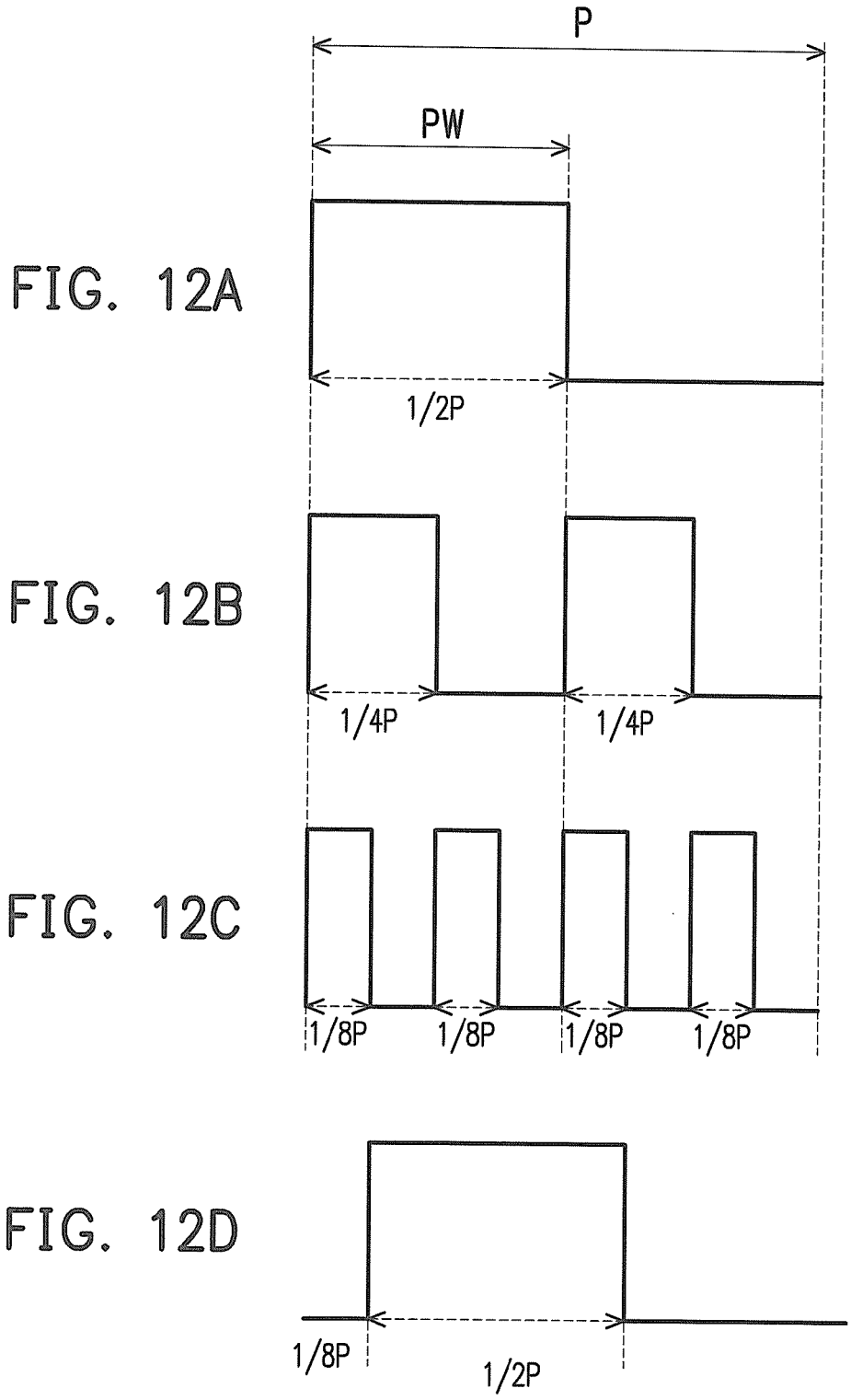
FIG. 12A to FIG. 12D are schematic diagrams illustrating waveforms of the pulse-width modulation to which the "non-obvious data transmission" method is applied according to an embodiment of the disclosure.

For example, FIG. 12A to FIG. 12D are schematic diagrams illustrating waveforms of the PWM to which the "non-obvious data transmission" method is applied according to an embodiment of the disclosure. Referring to FIG. 12A, according to the perceivable content such as sound or light, the operating unit 220 may determine a total pulse-width PW of a sound or light within a period P for pulse-width modulation. Although the total pulse-width PW depicted in FIG. 12A is P/2, the disclosure is not limited thereto. Different phases and different number of pulses may be selected for the same total pulse-width. FIG. 12B illustrates a pattern wherein two pulses are included in one period P, in which the width of each pulse is P/4. Accordingly, the total pulse-width PW of the waveform depicted in FIG. 12B is P/4+P/4=P/2. FIG. 12C illustrates a pattern wherein four pulses are included in one period P, in which the width of the each pulse is P/8. Accordingly, the total pulse-width PW of the waveform depicted in FIG. 12C is P/8+P/8+P/8+P/8=P/2. In FIG. 12D, although the total pulse-width PW is P/2, the pulse is 1/8P shifted. In FIG. 12A to FIG. 12D, the same total pulse-width PW are implemented in different phases or different number of pulses. For the same total pulse-width PW, the different phases and the different number of pulses cannot be identified by most of human perceptions (for example, visual perception or auditory perception). Therefore, the operating unit 220 may embed the communication data which is to be transmitted to the external electronic device in the sound or light of the perceivable content, such that the communication data is unable for human to notice. For example, if the communication data to be transmitted to the external electronic device is {00}, the operating unit 220 may select the pattern depicted in FIG. 12A. And if the communication data to be transmitted to the external electronic device is {01}, the operating unit 220 may select the pattern depicted in FIG. 12B. Accordingly, the operating unit 220 is capable of embedding the communication data in the sound or light of the perceivable content. By applying the aforesaid methods, an electronic sensing device is capable of detecting different transmitted data which is difficult or unable for human to notice. The electronic sensing device is, for example, a microphone or a phototransistor.

A material of the presentation units 110 depicted in FIG. 1A or FIG. 1B may be a plastic, a glass or other materials. In the embodiment depicted in FIG. 1A, the presentation unit 110 includes the transparent space, and the transparent space may be full transparent or translucent. The transparent space of the presentation unit 110 may be filled with solid (e.g. transparent materials such as the plastic or the glass), liquid (e.g. water, oil or other transparent liquids) or gas (e.g. air, nitrogen, helium or other gases), and may also be filled without any substance (e.g. vacuum). In some embodiments, an object (e.g. a ceramic craftwork, a glass, a metal, a plastic, a model, etc.) may be disposed in the transparent space of the presentation unit 110. In some other embodiments, there is no transparent space in the presentation unit 110, but an object/model (e.g. a ceramic craftwork, a glass, a plastic, a metal, a model, etc.) may be disposed in the presentation unit 110. The presentation unit 110 may include an object/model such as a spheroid, a musical instrument, a music box, a doll, a toy, a model or other shapes. The object/model is, for example, a transportation model (e.g. an aircraft, a train, a car, etc.) or a building model (e.g. Eiffel Tower, Sydney Opera House, Taipei 101, etc.). The perceivable content presented by the presentation unit 110 may include a sound corresponding to the object. For instance, for each the electronic devices 100, 710, 720, 730 and 740 depicted in FIG. 7, different models may be respectively disposed in the transparent space of the presentation unit 110, so as to indicate a feature of the perceivable content presented by each of the electronic devices 710, 720, 730 and 740. For instance, if a doll holding a microphone is disposed inside the transparent space of the electronic device 100, it may indicate that the electronic device 100 is capable of playing the voice of a singer. When the model disposed inside the presentation unit 110 is the musical instrument model, the perceivable content presented by the operating unit 220 includes a musical instrument sound corresponding to the musical instrument model. For instance, if a piano model is disposed inside the transparent space of the electronic device 730, it may indicate that the electronic device 730 is capable of playing the sound of piano.

In other embodiments, one or more dolls, models or toys may be disposed in the transparent space of each of the electronic devices 100, 710, 720, 730 and 740 depicted in FIG. 7. The dolls, the models or the toys are capable of dancing in correspondence to the perceivable content under the control of the control unit 210. Through the communications between the different electronic devices, the dolls inside the transparent spaces of the electronic devices 100, 710, 720, 730 and 740 are capable of collaboratively presenting actions such as dancing altogether.

Figure 13:
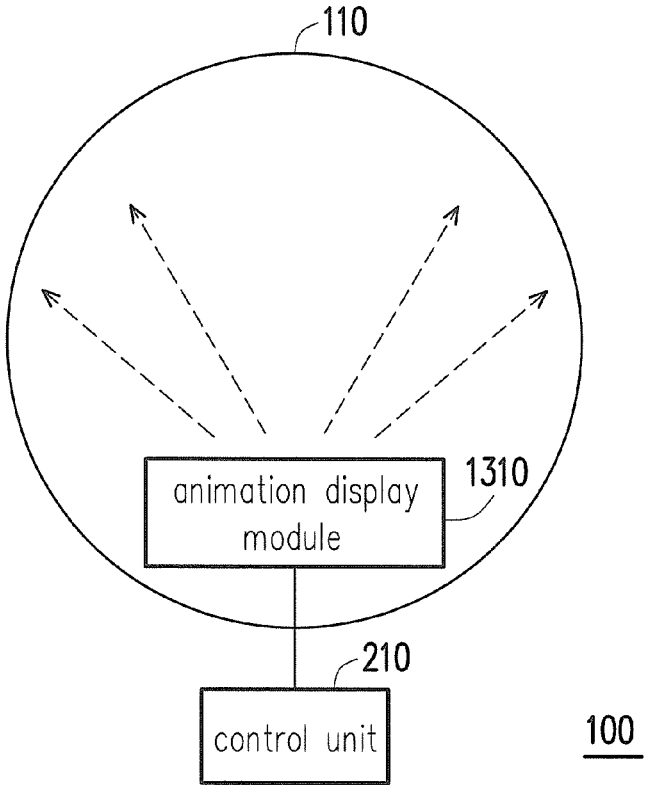
FIG. 13 is a block diagram illustrating circuitry of the electronic devices depicted in FIG. 1A, FIG. 1B and FIG. 2 according to another embodiment of the disclosure.

FIG. 13 is a block diagram illustrating circuitry of the electronic devices 100 depicted in FIG. 1A, FIG. 1B and FIG. 2 according to another embodiment of the disclosure. The embodiment depicted in FIG. 13 may be inferred by reference with related descriptions for FIG. 1A to FIG. 12D. The operating unit 220 of the electronic device 100 depicted in FIG. 13 includes an animation display module 1310. The animation display module 1310 (e.g. a laser animation projecting device, a liquid crystal display device, etc.) is electrically coupled to the control unit 210. The animation display module 1310 is disposed inside the transparent space of the presentation unit 110. The animation display module 1310 may project an animation or a dynamic text on a surface of the presentation unit 110 to present the perceivable content according to the control of the control unit 210. For example, the animation display module 1310 may project the animation of "the Santa Claus riding in a sleigh" on the surface of the presentation unit 110. As another example, the animation display module 1310 may project the dynamic text "Happy Birthday" on the surface of the presentation unit 110. Through the communications between different electronic devices, the animation display modules 1310 of the different electronic devices are capable of collaboratively presenting diverse animations or texts. In other embodiments, the electronic device 100 may also combine use of the functions from aforesaid embodiments, such that the different electronic devices 100 may collaboratively present the sound, the light, the performance and so on.

Figure 14A:
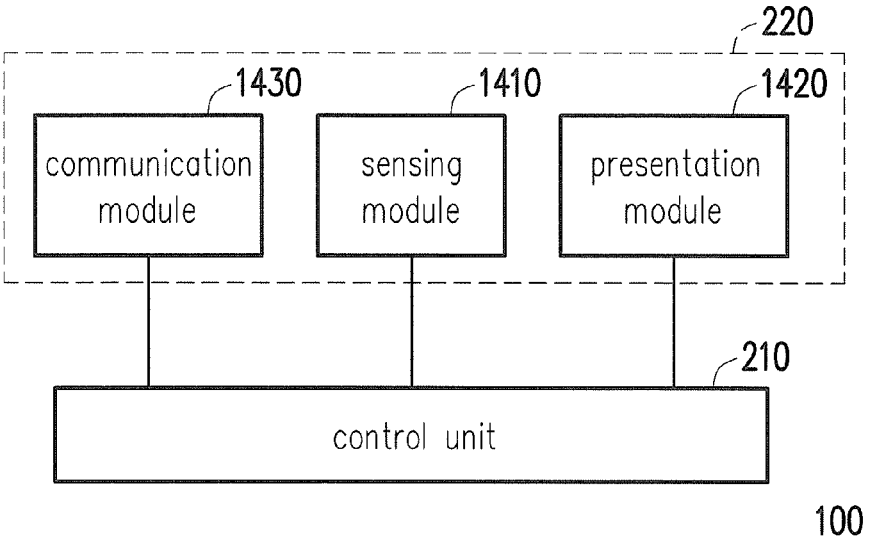
FIG. 14A is a block diagram illustrating circuitry of the electronic devices depicted in FIG. 1A or FIG. 1B according to yet another embodiment of the disclosure.

FIG. 14A is a block diagram illustrating circuitry of the electronic device 100 depicted in FIG. 1A or FIG. 1B according to yet another embodiment of the disclosure. The embodiment depicted in FIG. 14A may be inferred by reference with related descriptions for FIG. 1A to FIG. 13. The operating unit 220 depicted in FIG. 14A includes a sensing module 1410, a presentation module 1420 and a communication module 1430. The presentation module 1420 is capable of presenting the perceivable content under the control of the control unit 210. Based on requirements in different embodiments, the presentation module 1420 may include at least one of a speaker, a lamp, a motor and a smell generator. The communication module 1430 is electrically coupled to the control unit 210. The communication module 1430 includes a wireless communication capability for communicating with the external electronic device. For instance, the communication module 1430 includes the wireless communication capability to communicate with the external electronic device and/or the Internet. In some other embodiments, the operating unit 220 includes any two of the sensing module 1410, the presentation module 1420 and the communication module 1430. For example, the operating unit 220 includes the sensing module 1410 and the presentation module 1420. Or, the operating unit 220 includes the presentation module 1420 and the communication module 1430. Or, the operating unit 220 includes the sensing module 1410 and the communication module 1430. In other embodiments, the communication module 1430 may be independent from the operating unit 220.

As shown in FIG. 14A, the sensing module 1410, the presentation module 1420 and the communication module 1430 are electrically coupled to the control unit 210. The sensing module 1410 may detect or receive external events or signals (e.g. detecting external light or sound, or detecting event of an air commanding by various body parts, a shaking, a pushing-pulling, a beating, a blowing, or a palm-waving performed on the presentation unit by a user) and output the information which is contained in the external events or signals to the control unit 210 of the electronic device 100. The sensing module 1410 or the communication module 1430 of the operating unit 220 in electronic device 100 may also receive the external signal, in the manner of sound or light or radio frequency (RF) signal, transmitted from the external electronic device, and then transmit the information which is contained in the external signal to the control unit 210. The external signal may include data (e.g. music data, lighting display data, etc.), a command, a script or other information. The control unit 210 of the electronic device 100 may decide the perceivable content according the external signal. The external signal may be transmitted to the sensing module 1410 or the communication module 1430 using aforesaid "obvious data transmission" method or aforesaid "non-obvious data transmission" method.

The presentation module 1420 is electrically coupled to the control unit 210. The control unit 210 controls the presentation module 1420, such that the presentation unit 110 may present the perceivable content in the manner of sound or light, and communicate with the external electronic device in the manner of sound or light or by the RF signal. The presentation module 1420 of the operating unit 220 may transmit the data to the external electronic device by aforesaid "obvious data transmission" method or aforesaid "non-obvious data transmission" method. If the data is transmitted by the "non-obvious data transmission" method, the communication data transmitted by the presentation module 1420 in the manner of sound or light is unable for human to notice. In other words, the operating unit 220 transmits the communication data which is unable for human to notice to the external electronic device for communicating with the external electronic device. For instance, the control unit 210 controls the presentation module 1420 to determine a total pulse-width of the sound or light within a period for pulse-width modulation according to the perceivable content, and determines a number of pulses and a pulse phase within the period according to the communication data to be transmitted to the external electronic device.

The control unit 210 may also control the communication module 1430 to transmit data to the external electronic device in the manner of sound or light or by the RF signal. The control unit 210 may control the presentation module 1420 according to the external signal or data downloaded by the sensing module 1410 or the communication module 1430, so as to present the perceivable content on the presentation unit 110 in the manner of sound or light according to the external signal. The control unit 210 may also control the presentation module 1420 according to the events detected by the sensing module 1410, so as to present the perceivable content on the presentation unit 110 in the manner of sound or light, wherein the events may be, for example, the air commanding by various body parts, the shaking, the pushing-pulling, the beating, the blowing, and/or the palm-waving performed on the presentation unit by the user. For example, according to a speed and/or a strength of the aforementioned events, the control unit 210 may correspondingly control a playback speed, a tune and/or a volume of the music presented by the presentation module 1420.

Figure 14B:
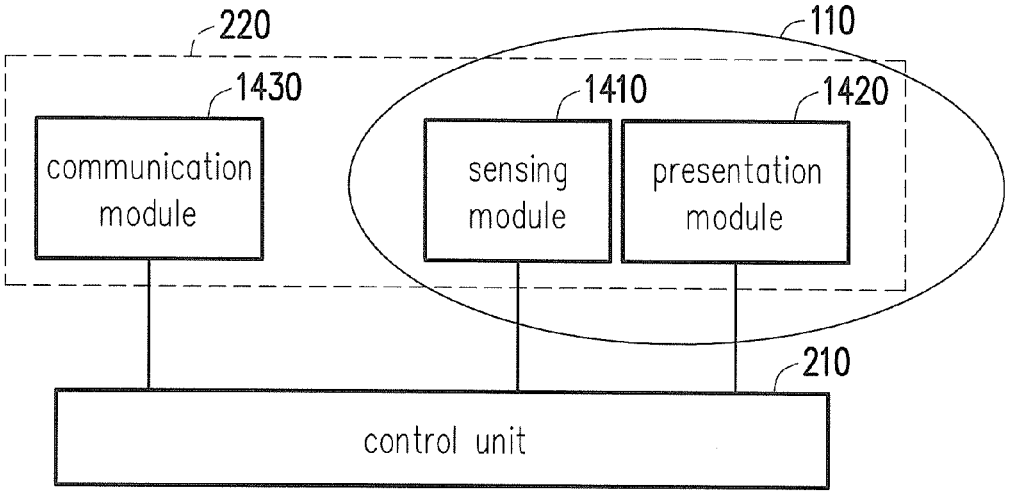
FIG. 14B is a block diagram illustrating circuitry of the electronic devices depicted in FIG. 1A or FIG. 1B according to still another embodiment of the disclosure.

FIG. 14B is a block diagram illustrating circuitry of the electronic devices 100 depicted in FIG. 1A or FIG. 1B according to still another embodiment of the disclosure. The embodiment depicted in FIG. 14B may be inferred by reference with related descriptions for FIG. 1A to FIG. 13. The operating unit 220 depicted in FIG. 14B includes a sensing module 1410, a presentation module 1420 and a communication module 1430. In the embodiment depicted in FIG. 14B, the sensing module 1410 and/or the presentation module 1420 may be disposed in the presentation unit 110. The sensing module 1410, the presentation module 1420 and the communication module 1430 depicted in FIG. 14B may be inferred by reference with related description for FIG. 14A, which is not repeated hereinafter.

In an embodiment, the electronic devices 100 depicted in FIG. 14A or FIG. 14B may be implemented as one of instrumental ensemble devices depicted in FIG. 7, so as to perform an instrumental ensemble together with the external electronic devices 710, 720, 730 and/or 740. This electronic device 100 for presenting perceivable content includes the control unit 210, the operating unit 220 and the communication module 1430. The operating unit 220 is electrically coupled to the control unit 210. The operating unit 220 presents the perceivable content by the sound under the control of the control unit 210. The communication module 1430 is electrically coupled to the control unit 210. The communication module 1430 has the wireless communication capability (e.g. a RF communication) in order to communicate with the external electronic device (e.g. another electronic device for presenting perceivable content, a microprocessor, a computer, a notebook computer, a tablet computer, a cell phone, a server, or other electronic instrumental ensemble devices). In another embodiment, the sensing module 1410 may sense the speed and/or the strength of the events of the shaking, the pushing-pulling, the beating, the blowing, the palm-waving and/or the air commanding by various body parts. The control unit 210 correspondingly controls the presentation module 1420 to vary the speed, the tune and the volume of according to a sensing result of the sensing module 1410. In an embodiment, the control unit 210 may transmit the synchronous data (e.g. the music number, the timestamp, the beacon, the paragraph, the note, the starting trigger or the ending trigger) of the music played by the operating unit 220 to the external electronic device via the communication module 1430. The external electronic device starts to play an ensemble music corresponding to the synchronous data after receiving the synchronous data of the music. The electronic device 100 for presenting perceivable content (e.g. the instrumental ensemble device) may join in synchronously playing the ensemble music at any chapter or note sequence of the ensemble music. A synchronization process of the instrumental ensemble devices may refer to related descriptions for FIG. 3 to FIG. 7, which are not repeated hereinafter.

In another embodiment, the electronic devices 100 depicted in FIG. 14A or FIG. 14B may be implemented as a chorus device. The electronic device 100 may perform a chorus together with the external electronic devices. When there are other chorus devices (e.g. the external electronic devices) near the electronic device 100, the electronic device 100 performs duet or chorus of one specific song together with the external electronic devices. If the external electronic devices nearby do not have related data of the song (e.g. a part of the music), the control unit 210 of the electronic device 100 may also transmit the related data of the song to the external electronic devices via the operating unit 220 for performing duet or chorus of the song later.

Figure 15:
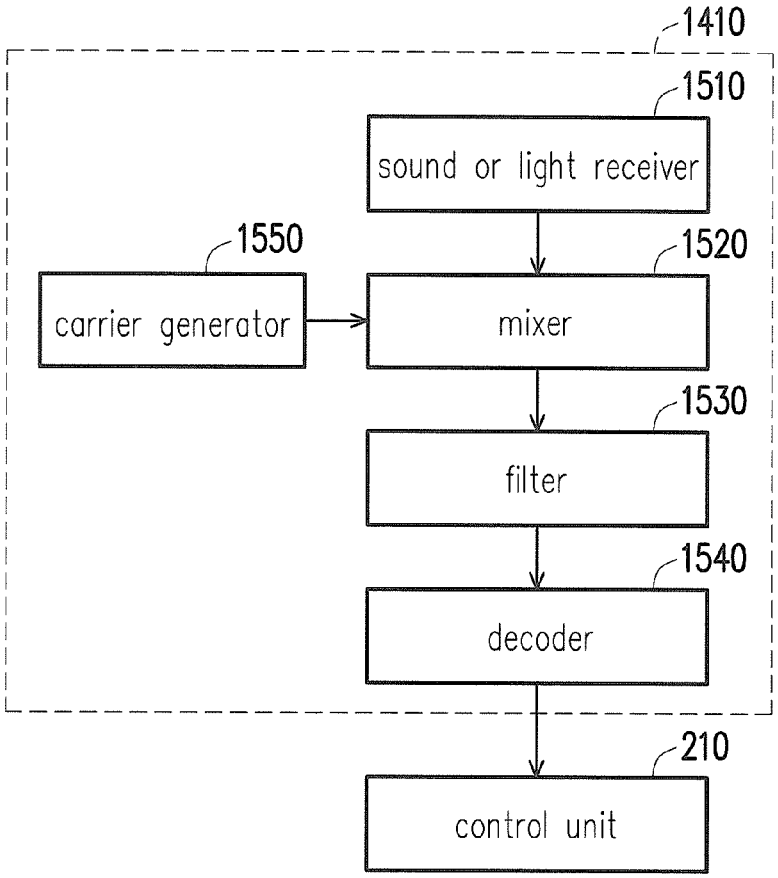
FIG. 15 is a block diagram illustrating circuitry of the sensing modules depicted in FIG. 14A or FIG. 14B according to an embodiment of the disclosure.

FIG. 15 is a block diagram illustrating circuitry of the sensing modules 1410 depicted in FIG. 14A or FIG. 14B according to an embodiment of the disclosure. The sensing module 1410 depicted in FIG. 15 includes a sound or light receiver 1510, a mixer 1520, a filter 1530, a decoder 1540, and a carrier generator 1550. The sound or light receiver 1510 may include a sound sensor (e.g. the microphone) and/or the photo sensor. The sound or light receiver 1510 is configured to detect or receive the external events or signals and output a sensed signal. The mixer 1520 is coupled to the sound or light receiver 1510 to receive the sensed signal. The mixer 1520 down-converts the sensed signal outputted by the sound or light receiver 1510 into a baseband signal according to a carrier frequency provided by the carrier generator 1550. The filter 1530 is coupled to the mixer 1520 to receive the baseband signal and output a filtered signal. The decoder 1540 is coupled to the filter 1530 to receive the filtered signal and decode the filtered signal to obtain an external information which is contained in the external events or signals. The decoder 1540 transmits the received external information to the control unit 210. In an embodiment, the sound or light receiver 1510, the mixer 1520, the filter 1530 may be integrated into one component. In an embodiment, some of the aforementioned components may be selectively omitted.

Figure 16:
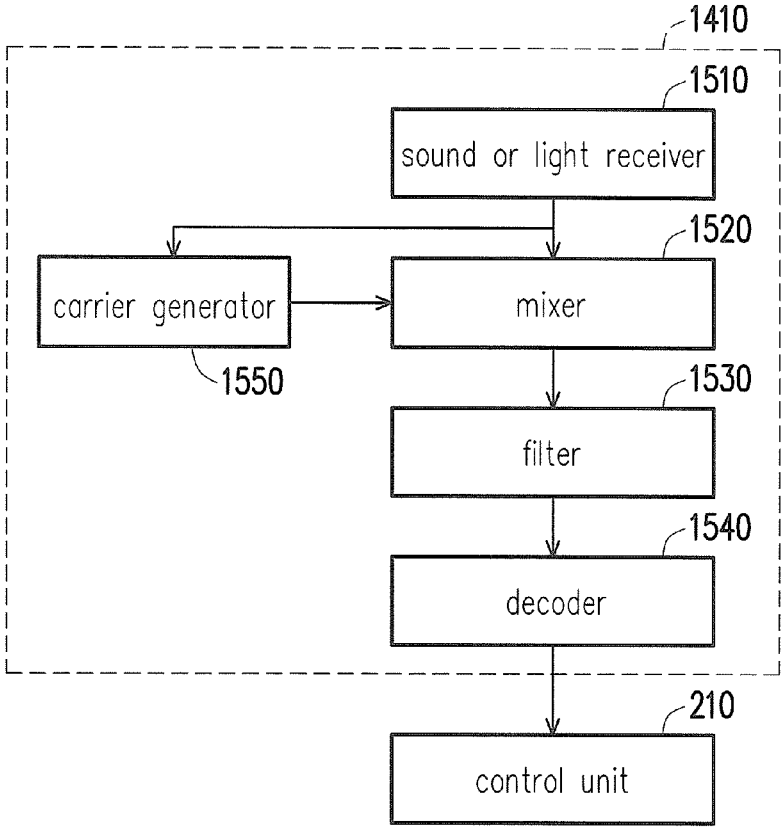
FIG. 16 is a block diagram illustrating circuitry of the sensing modules depicted in FIG. 14A or FIG. 14B according to another embodiment of the disclosure.

FIG. 16 is a block diagram illustrating circuitry of the sensing modules 1410 depicted in FIG. 14A or FIG. 14B according to another embodiment of the disclosure. The embodiment depicted in FIG. 16 may be inferred by reference with related description for FIG. 15. The carrier frequency of the carrier generator 1550 depicted in FIG. 16 may be dynamically changed. For example, in the embodiments depicted in FIG. 10 and FIG. 11, the frequency shift or modulation is added to the note of the music, wherein the note is the carrier. Therefore, during the entire transmission, the carrier frequency (the note frequency in the music) is constantly changed along with the music content. First, the carrier generator 1550 detects the carrier frequency and decodes a coarse frequency of the note. The mixer 1520 then mixes the coarse frequency and the signals which may contain the frequency shift, and the filter 1530 generates the frequency shift. Then, the received information may be decoded by the decoder 1540.

Figure 17:
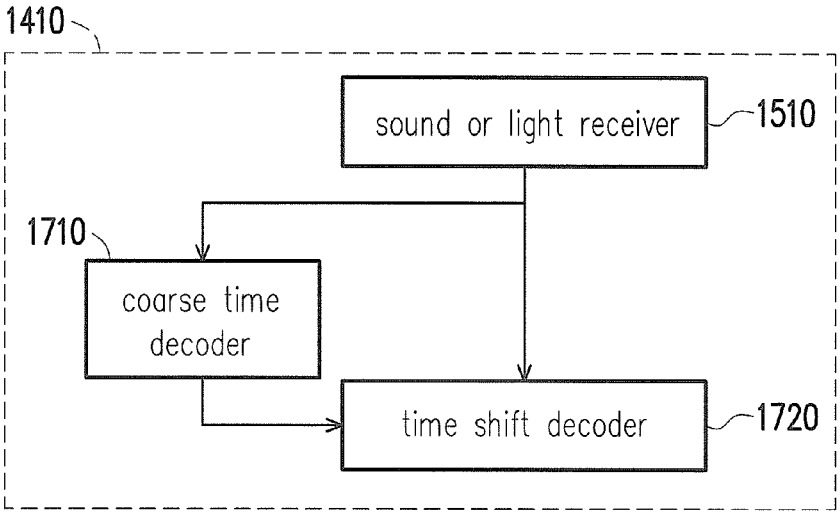
FIG. 17 is a block diagram illustrating circuitry of the sensing modules depicted in FIG. 14A or FIG. 14B according to yet another embodiment of the disclosure.

FIG. 17 is a block diagram illustrating circuitry of the sensing modules 1410 depicted in FIG. 14A or FIG. 14B according to yet another embodiment of the disclosure. The embodiment depicted in FIG. 17 may refer to related descriptions for the embodiments of FIG. 8 and FIG. 9. The embodiment depicted in FIG. 17 may be inferred by reference with related descriptions for FIG. 15 and FIG. 16. Referring to FIG. 17, the sensing module 1410 includes the sound or light receiver 1510, a coarse time decoder 1710 and a time shift decoder 1720. The sound or light receiver 1510 is configured to detect or receive the external events or signals and output a sensed signal. The coarse time decoder 1710 is coupled to the sound or light receiver 1510 to receive the sensed signal, perform a coarse time decoding on the sensed signal, and output a coarse time decoding result to the time shift decoder 1720. Implementation details regarding the coarse time decoder 1710 may refer to related descriptions for the carrier generators 1550 depicted in FIG. 15 and/or FIG. 16. The time shift decoder 1720 is coupled to the sound or light receiver 1510 to receive the sensed signal, perform a time shift decoding on the sensed signal according to the coarse time decoding result, and output a time shift decoding result (the external information which is contained in the external events or signals) to the control unit 210. Implementation details regarding the time shift decoder 1720 may refer to related descriptions for the mixer 1520, the filter 1530 and the decoder 1540 depicted in FIG. 15 and/or FIG. 16.

Figure 18:
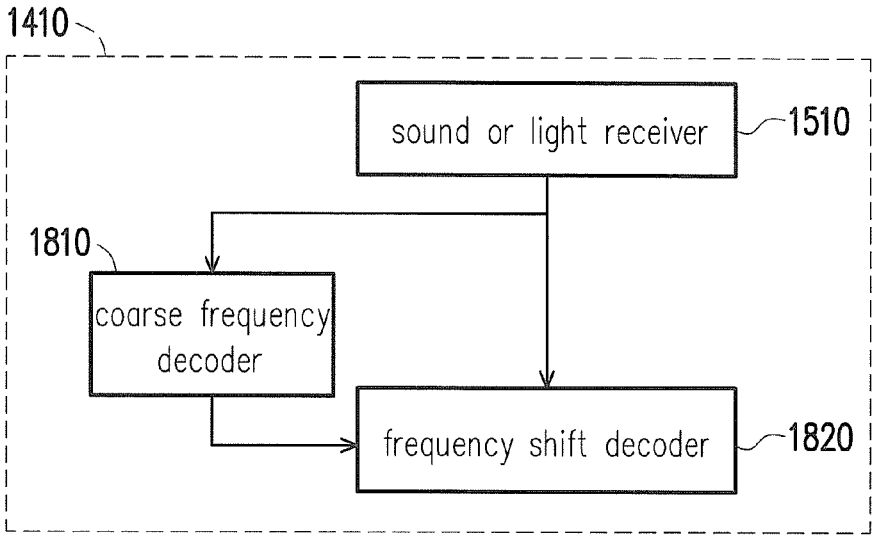
FIG. 18 is a block diagram illustrating circuitry of the sensing modules depicted in FIG. 14A or FIG. 14B according to yet another embodiment of the disclosure.

FIG. 18 is a block diagram illustrating circuitry of the sensing modules 1410 depicted in FIG. 14A or FIG. 14B according to yet another embodiment of the disclosure. The embodiment depicted in FIG. 18 may refer to related descriptions for the embodiments of FIG. 10 and FIG. 11. The embodiment depicted in FIG. 18 may be inferred by reference with related description for FIG. 15. Referring to FIG. 18, the sensing module 1410 includes the sound or light receiver 1510, a coarse frequency decoder 1810 and a frequency shift decoder 1820. The sound or light receiver 1510 is configured to detect or receive the external events or signals and output a sensed signal. The coarse frequency decoder 1810 is coupled to the sound or light receiver 1510 to receive the sensed signal, perform a coarse frequency decoding on the sensed signal, and output a coarse frequency decoding result to the frequency shift decoder 1820. Implementation details regarding the coarse frequency decoder 1810 may refer to related descriptions for the carrier generators 1550 depicted in FIG. 15 and/or FIG. 16. The frequency shift decoder 1820 is coupled to the sound or light receiver 1510 to receive the sensed signal, perform a frequency shift decoding on the sensed signal according to the coarse frequency decoding result, and output a frequency shift decoding result (the external information which is contained in the external events or signals) to the control unit 210. Implementation details regarding the frequency shift decoder 1820 may refer to related descriptions for the mixer 1520, the filter 1530 and the decoder 1540 depicted in FIG. 15 and/or FIG. 16.

Figure 19:
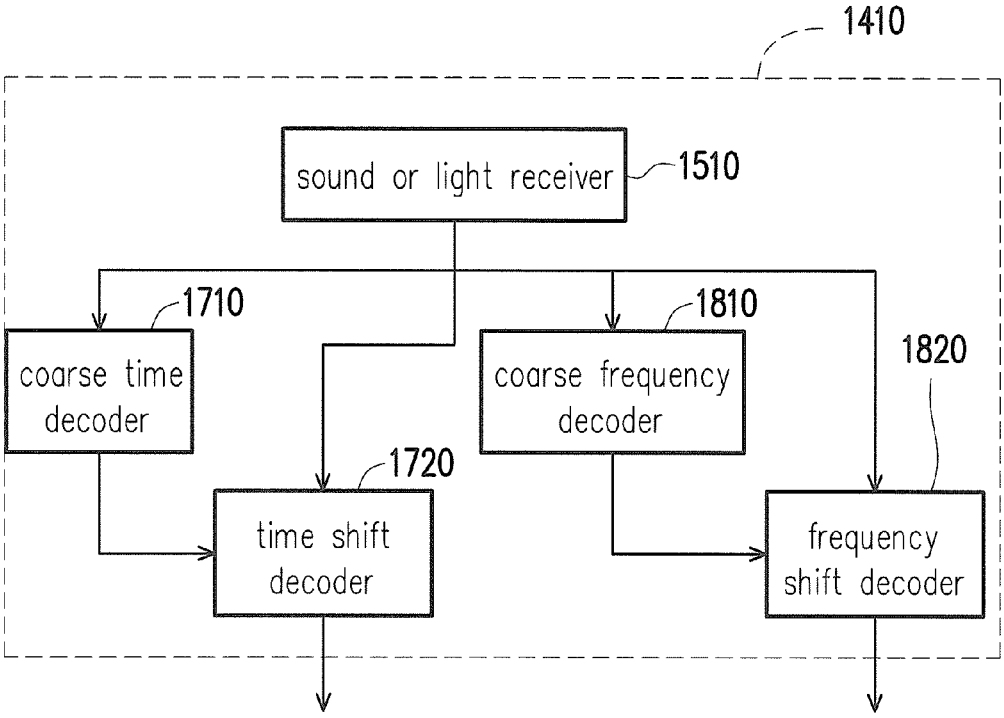
FIG. 19 is a block diagram illustrating circuitry of the sensing modules depicted in FIG. 14A or FIG. 14B according to still another embodiment of the disclosure.

FIG. 19 is a block diagram illustrating circuitry of the sensing modules 1410 depicted in FIG. 14A or FIG. 14B according to another embodiment of the disclosure. Referring to FIG. 19, the sensing module 1410 includes the sound or light receiver 1510, the coarse time decoder 1710, the time shift decoder 1720, the coarse frequency decoder 1810 and the frequency shift decoder 1820. The embodiment depicted in FIG. 19 may be inferred by reference with related description for FIG. 17 and FIG. 18. According to the coarse time decoding result provided by the coarse time decoder 1710, the time shift decoder 1720 performs the time shift decoding on the sensed signal outputted by the sound or light receiver 1510, so as to output the time shift decoding result to the control unit 210. According to the coarse frequency decoding result provided by the coarse frequency decoder 1810, the frequency shift decoder 1820 performs the frequency shift decoding on the sensed signal outputted by the sound or light receiver 1510, so as to output the frequency shift decoding result to the control unit 210. Accordingly, the embodiment depicted in FIG. 19 is capable of performing the time shift decoding and the frequency shift decoding simultaneously.

Figure 20:
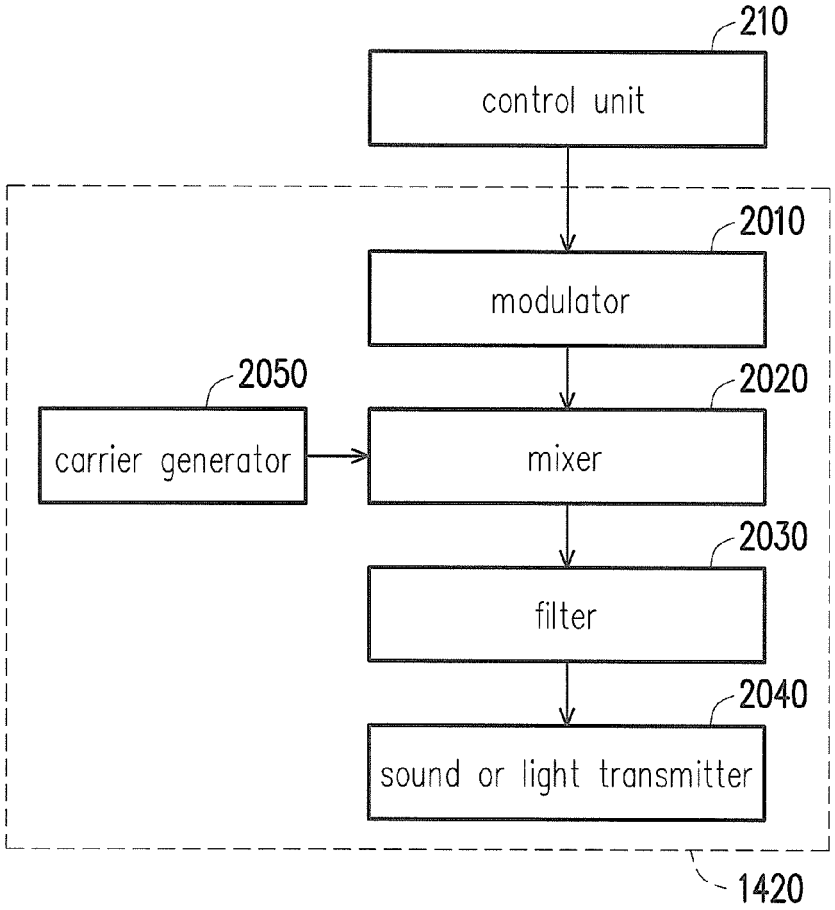
FIG. 20 is a block diagram illustrating circuitry of the presentation modules depicted in FIG. 14A or FIG. 14B according to an embodiment of the disclosure.

FIG. 20 is a block diagram illustrating circuitry of the presentation modules 1420 depicted in FIG. 14A or FIG. 14B according to an embodiment of the disclosure. The presentation module 1420 depicted in FIG. 20 includes a modulator 2010, a mixer 2020, a filter 2030, a sound or light transmitter 2040, and a carrier generator 2050. The control unit 210 may transmit the communication data and sound or light data to the modulator 2010. The sound or light data are data corresponding to the perceivable content to be presented by the electronic device 100, and the communication data are data (e.g. the command for synchronism or the script) to be transmitted to the external electronic device. The modulator 2010 may modulate the sound or light data according to the communication data, and output a modulated data. The mixer 2020 is coupled to the modulator 2010 to receive the modulated data. The mixer 2020 loads the modulated data on a carrier outputted by a carrier generator 2050, and outputs a mixed signal. The filter 2030 is coupled to the mixer 2020 to receive the mixed signal and output a filtered signal. The sound or light transmitter 2040 is coupled to the filter 2030 to receive the filtered signal. According to the filtered signal, the sound or light transmitter 2040 emits a sound or light to present the perceivable content while transmitting the communication data to the external electronic device, wherein the communication data are embedded in perceivable content.

Figure 21:
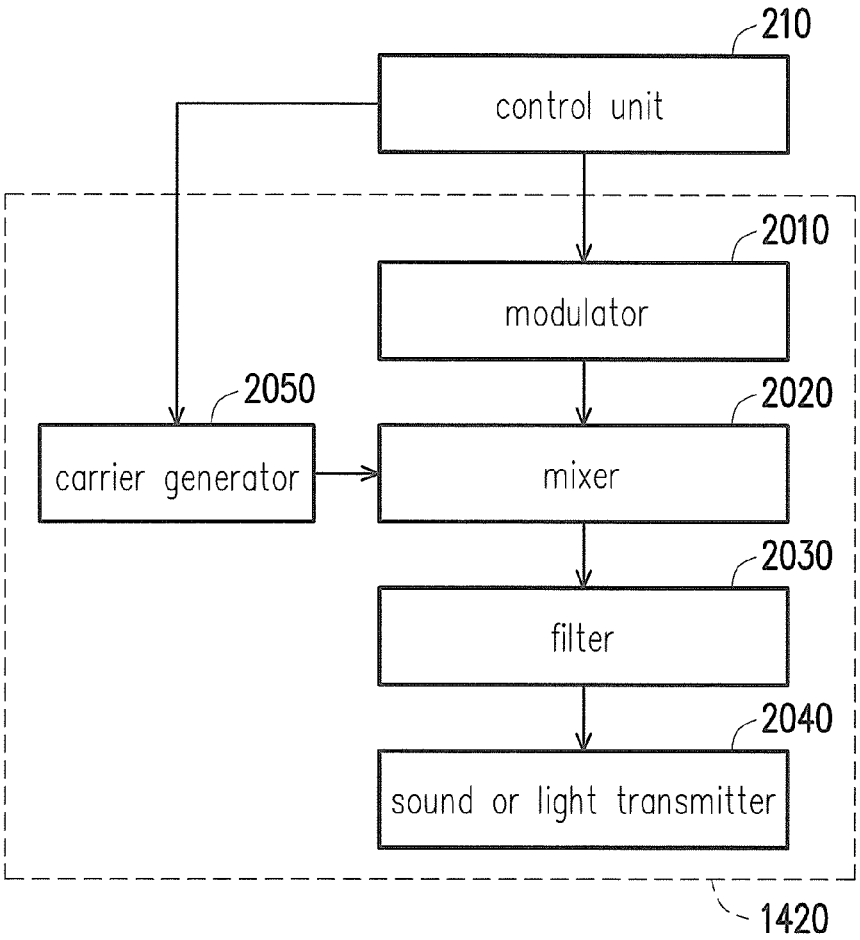
FIG. 21 is a block diagram illustrating circuitry of the presentation modules depicted in FIG. 14A or FIG. 14B according to another embodiment of the disclosure.

FIG. 21 is a block diagram illustrating circuitry of the presentation modules 1420 depicted in FIG. 14A or FIG. 14B according to another embodiment of the disclosure. The embodiment depicted in FIG. 21 may be inferred by reference with related description for FIG. 20. The carrier frequency of the carrier generator 2050 depicted in FIG. 21 may be dynamically changed according to the control unit 210. For example, in the embodiments depicted in FIG. 10 and FIG. 11, the frequency shift or modulation is added to the note of the music, wherein the note is the carrier. Therefore, during the entire transmission, the carrier frequency (the note frequency in the music) is constantly changed along with the music content. Based on requirements of the control unit 210 for playing the sound and light, the carrier generator 2050 generates the carrier frequency while the control unit 210 outputs the data, which are to be transmitted, to the modulator 2010 to perform a time shift modulation or a frequency shift modulation. The mixer 2020 then mixes the carrier frequency and the signals which may contain the frequency shift or the time shift. The filter 2030 generates a shifted frequency or a shifted time, and correspondingly emits the sound or light via the sound or light transmitter 2040.

Figure 22:
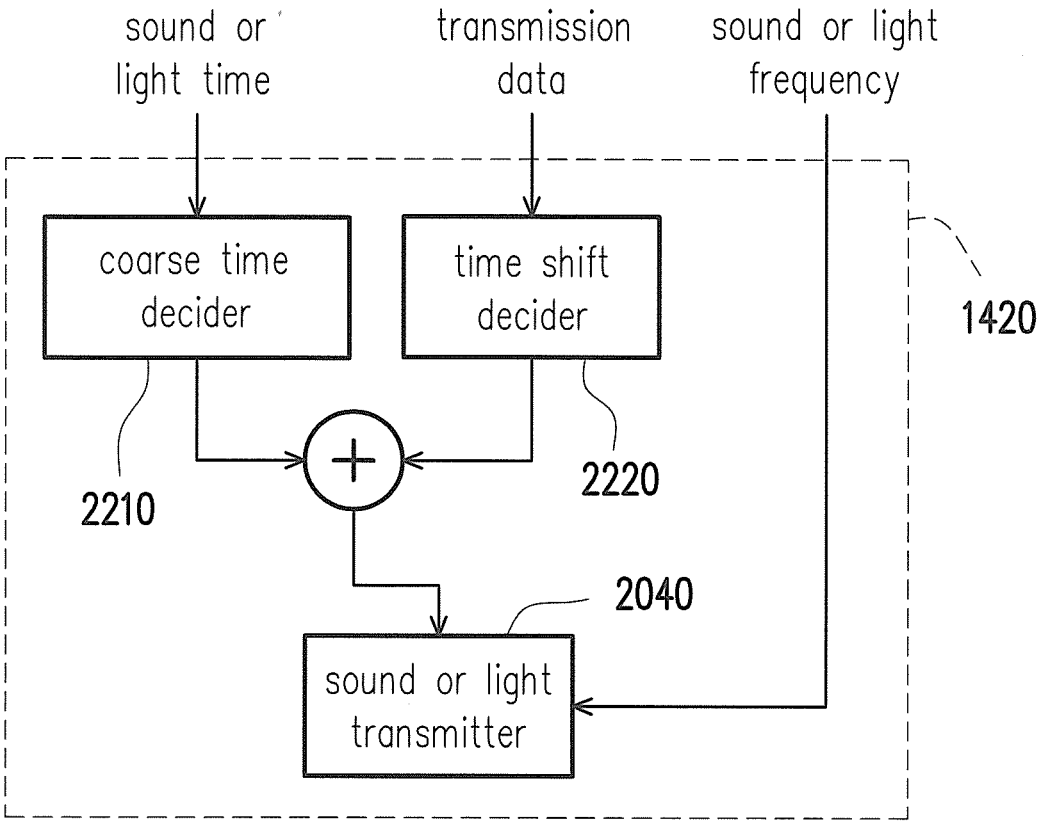
FIG. 22 is a block diagram illustrating circuitry of the presentation modules depicted in FIG. 14A or FIG. 14B according to yet another embodiment of the disclosure.

FIG. 22 is a block diagram illustrating circuitry of the presentation module 1420 depicted in FIG. 14A or FIG. 14B according to yet another embodiment of the disclosure. The embodiment depicted in FIG. 22 may be inferred by reference with related description for FIG. 20. Referring to FIG. 22, the control unit 210 transmits an individual sound or light playing time required for presenting the perceivable content (i.e., "sound or light time" as indicated in FIG. 22) to a coarse time decider 2210. Based on the control of the control unit 210, the coarse time decider 2210 decides the individual sound or light playing time required for presenting the sound or light in order to generate a coarse time. The control unit 210 transmits the transmission data (the communication data such as the command for synchronism or the script, that is, "transmission data" as indicated in FIG. 22) to be transmitted to the external electronic device to a time shift decider 2220. The time shift decider 2220 decides a time shift according to the transmission data. The control unit 210 transmits a frequency of the sound or light (i.e., "sound or light frequency" as indicated in FIG. 22) to the sound or light transmitter 2040. According to the sound or light frequency designated by the control unit 210 and a sum of the times decided by the coarse time decider 2210 and the time shift decider 2220, the sound or light transmitter 2040 correspondingly emits the sound or light.

Figure 23:
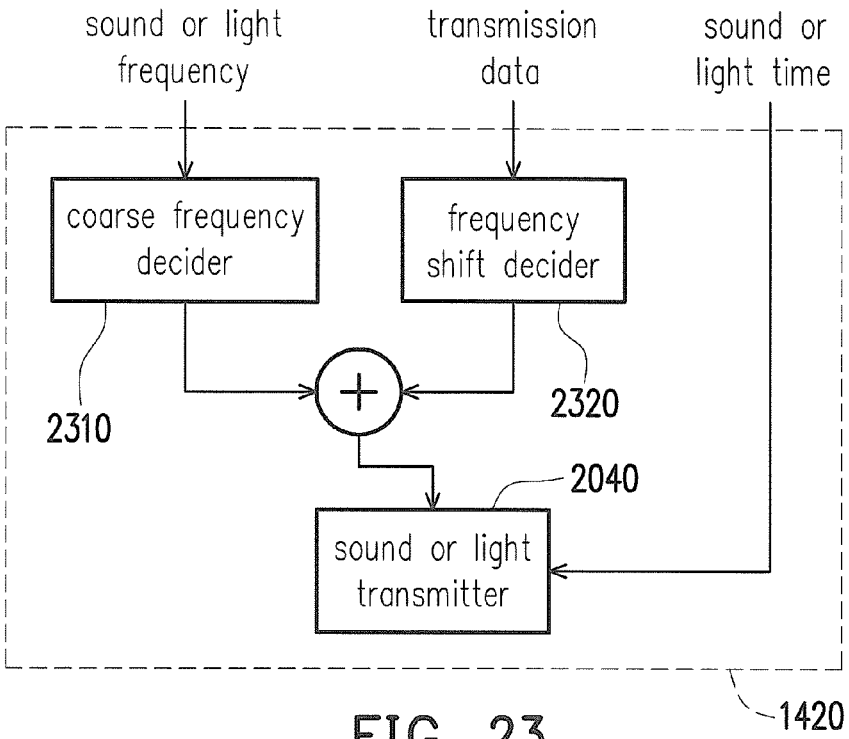
FIG. 23 is a block diagram illustrating circuitry of the presentation modules depicted in FIG. 14A or FIG. 14B according to yet another embodiment of the disclosure.

FIG. 23 is a block diagram illustrating circuitry of the presentation modules 1420 depicted in FIG. 14A or FIG. 14B according to yet another embodiment of the disclosure. The embodiment depicted in FIG. 23 may be inferred by reference with related description for FIG. 20. Referring to FIG. 23, the control unit 210 transmits the frequency of the sound or light (i.e., "sound or light frequency" as indicated in FIG. 23) designated for presenting the perceivable content to a coarse frequency decider 2310. Based on the control of the control unit 210, the coarse frequency decider 2310 decides an individual sound or light playing frequency required for presenting the sound or light in order to generate a coarse frequency. The control unit 210 transmits the transmission data (the communication data such as the command for synchronism or the script, that is, "transmission data" as indicated in FIG. 23) to be transmitted to the external electronic device to a frequency shift decider 2320. The frequency shift decider 2320 decides a frequency shift according to the data to be transmission transmitted. The control unit 210 transmits an individual sound or light playing time (i.e., "sound or light time" as indicated in FIG. 23) to the sound or light transmitter 2040. According to the sound or light time designated by the control unit 210 and a sum of the frequencies decided by the coarse frequency decider 2310 and the frequency shift decider 2320, the sound or light transmitter 2040 correspondingly emits the sound or light.

Figure 24:
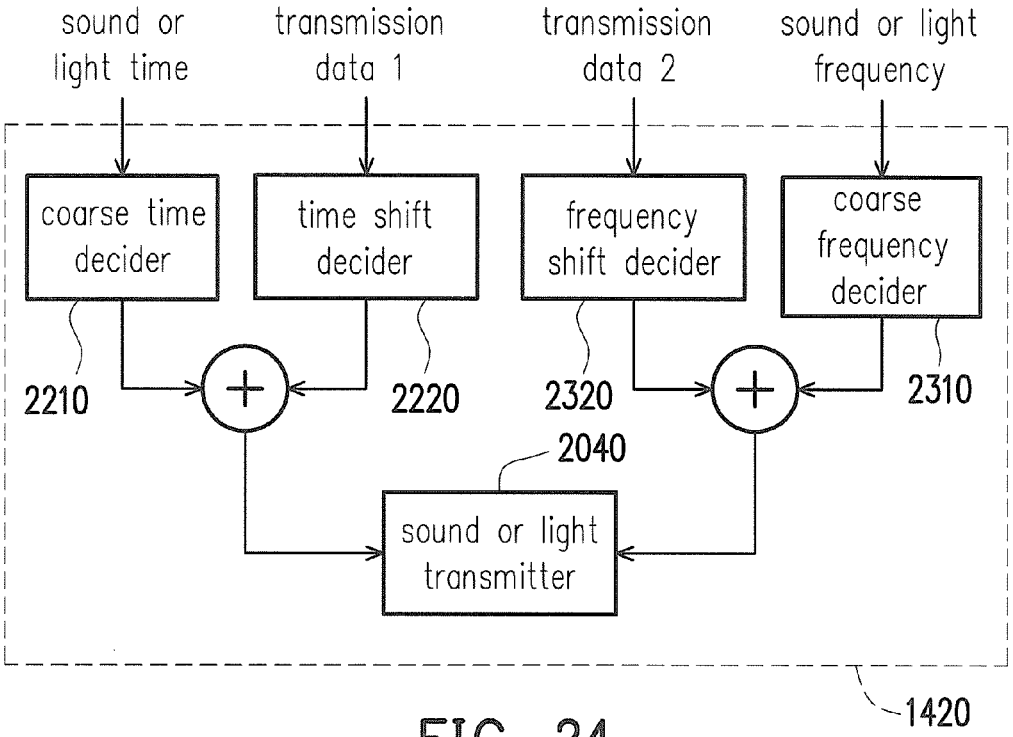
FIG. 24 is a block diagram illustrating circuitry of the presentation modules depicted in FIG. 14A or FIG. 14B according to still another embodiment of the disclosure.

FIG. 24 is a block diagram illustrating circuitry of the presentation modules 1420 depicted in FIG. 14A or FIG. 14B according to another embodiment of the disclosure. Referring to FIG. 24, the presentation module 1420 includes the coarse time decider 2210, the time shift decider 2220, the coarse frequency decider 2310, the frequency shift decider 2320 and the sound or light transmitter 2040. The embodiment depicted in FIG. 24 may be inferred by reference with related description for FIG. 22 and FIG. 23. According to the sum of the times decided by the coarse time decider 2210 and the time shift decider 2220 and the sum of the frequencies decided by the coarse frequency decider 2310 and the frequency shift decider 2320, the sound or light transmitter 2040 correspondingly transmits the sound or light. Accordingly, the embodiment depicted in FIG. 24 is capable of playing the sound or light while performing a time shift encoding and a frequency shift encoding simultaneously.

Figure 25:
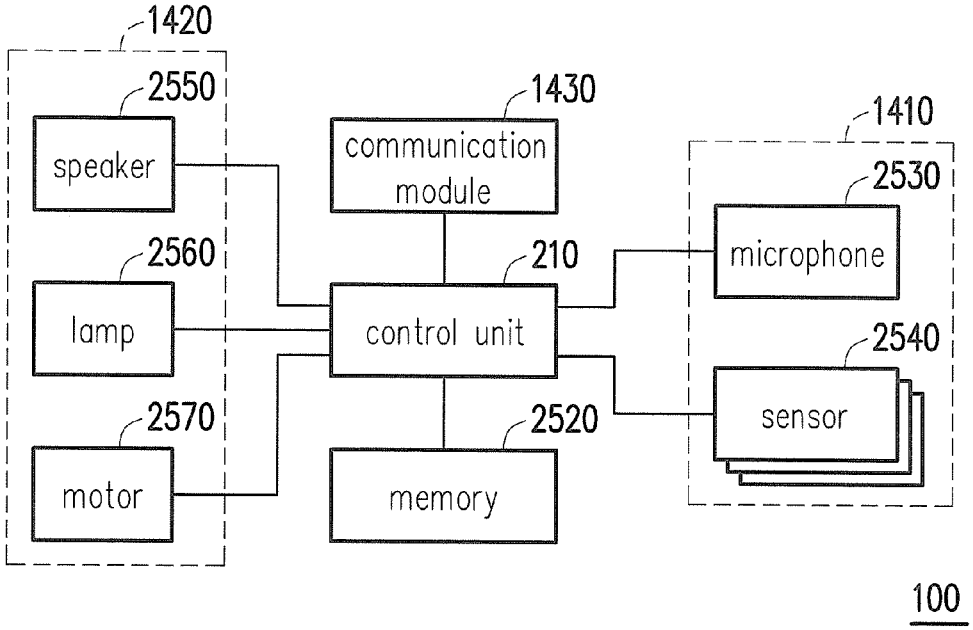
FIG. 25 is a block diagram illustrating circuitry of the electronic devices depicted in FIG. 1A or FIG. 1B according to again another embodiment of the disclosure.

FIG. 25 is a block diagram illustrating circuitry of the electronic devices 100 depicted in FIG. 1A or FIG. 1B according to again another embodiment of the disclosure. The embodiment depicted in FIG. 25 may be inferred by reference with related descriptions for FIG. 1A to FIG. 24. In an embodiment, the electronic device 100 depicted in FIG. 25 may be implemented as an instrumental ensemble device. The electronic device 100 depicted in FIG. 25 includes the control unit 210, the sensing module 1410, the presentation module 1420, the communication module 1430 and a memory 2520. Related data of the perceivable content (e.g. a music file, lighting control data, the script, etc.) may be stored in the memory 2520. The memory 2520 may be any type of memories, such as non-volatile memory (NVM) or similar memories, which are not limited in the disclosure. The sensing module 1410 and the presentation module 1420 may be included in the operating unit 220. In another embodiment, functions of the communication module 1430 may be included in the sensing module 1410 or the presentation module 1420, and may also be included in the operating unit 220 to serve as an internal module of the operating unit 220. In another embodiment, a communication function among the functions of the communication module 1430 may be implemented by the operating unit 220, and the communication function may also be implemented by a part of modules in the operating unit 220 such as the sensing module 1410 or the presentation module 1420.

The sensing module 1410 depicted in FIG. 25 includes a microphone 2530 and a sensor 2540. The microphone 2530 and the sensor 2540 are electrically coupled to the control unit 210. The sensor 2540 may include a three-axis sensor, a compass sensor, a mercury switch, a ball switch, a photo sensor, a touch sensor, or other sensors. The three-axis sensor is, for example, a g-sensor, a gyro sensor and so on. The control unit 210 may detect or receive the external events, signals, or physical changes via the sensor 2540. In an embodiment, the control unit 210 may sense an opening degree of fingers or a number of fingers of the user outside the presentation unit 110 via the sensor 2540 (e.g. the photo sensor). In another embodiment, the sensor 2540 (e.g. the touch sensor) may be disposed on a surface of the presentation unit 110, so as to sense a touch gesture of the user on the presentation unit 110.

Figure 26:
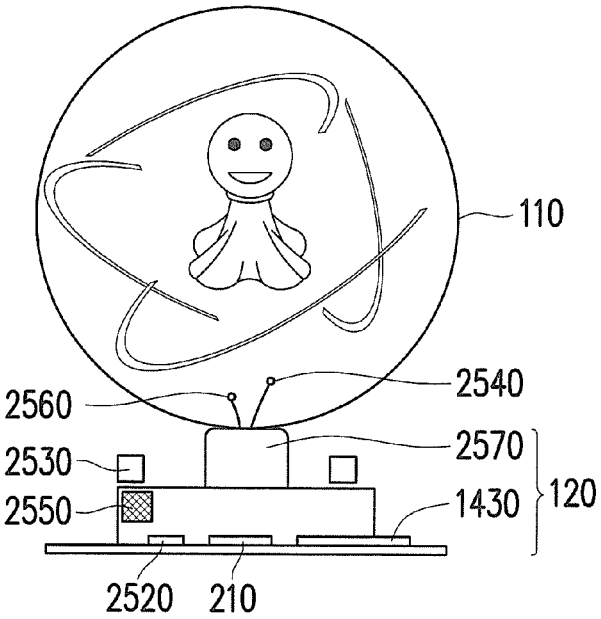
FIG. 26 is a block diagram illustrating a scheme of the electronic device depicted in FIG. 25 according to an embodiment of the disclosure.

The presentation module 1420 depicted in FIG. 25 includes a speaker 2550, a lamp 2560 and a motor 2570. FIG. 26 is a block diagram illustrating a scheme of the electronic device 100 depicted in FIG. 25 according to an embodiment of the disclosure. The embodiment depicted in FIG. 26 may be inferred by reference with related descriptions for FIG. 1A or FIG. 1B. Referring to FIG. 25 and FIG. 26, the sensor 2540 is partially or entirely disposed inside the presentation unit 110, or may be disposed inside the base 120. For example, the photo sensor and/or the touch sensor in the sensor 2540 may be disposed on the presentation unit 110, and the rest of the sensors (e.g. the g-sensor) may be disposed on the base 120. The lamp 2560 is partially or entirely disposed inside the presentation unit 110. The control unit 210, the communication module 1430, the memory 2520, the microphone 2530, the speaker 2550 and the motor 2570 are disposed on the base 120. In one embodiment, the motor 2570 is capable of rotating the presentation unit 110. The control unit 210, the communication module 1430, the memory 2520, the microphone 2530, the speaker 2550 and the motor 2570 may be partially or entirely disposed inside the base 120, and may also be partially or entirely disposed inside the presentation unit 110.

In one embodiment, when an external signal (e.g. the sound) is detected by the microphone 2530 and the information corresponding to the external signal is sent to the control unit 210, the control unit 210 may correspondingly control a rotating speed of the motor 2570 according to a strength, a scale or a rhythm of the external signal. In another embodiment, the control unit 210 may correspondingly control a color, a flickering frequency or a brightness of the lamp 2560 according to the strength, the scale or the rhythm of the external signal. In still another embodiment, the control unit 210 may correspondingly control a volume of the speaker 2550 according to the strength, the scale or the rhythm of the external signal. In yet another embodiment, the control unit 210 may correspondingly control a smell generated by the smell generator according to the strength, the scale or the rhythm of the external signal.

In one embodiment, when the sensor 2540 senses a movement of the electronic device 100 and the information corresponding to the movement is sent to the control unit 210, the control unit 210 may correspondingly control the rotating speed of the motor 2570 according to the movement of the electronic device 100. In another embodiment, the control unit 210 may correspondingly control the color, the flickering frequency or the brightness of the lamp 2560 according to the movement of the electronic device 100. In still another embodiment, the control unit 210 may correspondingly control the volume of the speaker 2550 according to the movement of the electronic device 100. In yet another embodiment, the control unit 210 may correspondingly control the smell generated by the smell generator according to the movement of the electronic device 100.

In one embodiment, when the sensor 2540 senses a touch event on the presentation unit 110 and the information corresponding to the touch event is sent to the control unit 210, the control unit 210 may correspondingly control the rotating speed of the motor 2570 according to the touch event. In another embodiment, the control unit 210 may correspondingly control the color, the flickering frequency or the brightness of the lamp 2560 according to the touch event. In still another embodiment, the control unit 210 may correspondingly control the volume of the speaker 2550 according to the touch event. In yet another embodiment, the control unit 210 may correspondingly control the smell generated by the smell generator according to the touch event.

Figure 27:
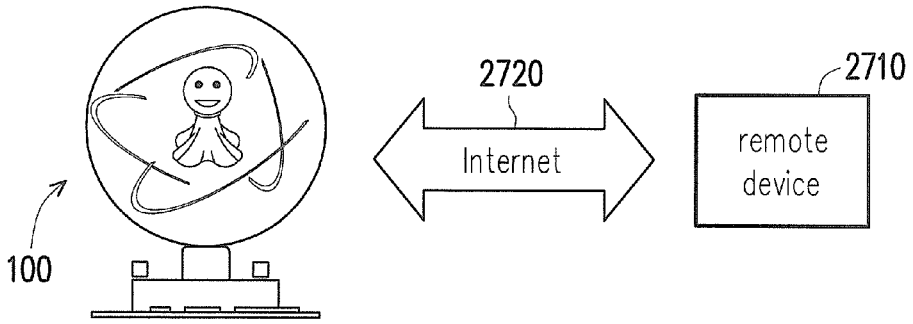
FIG. 27 is a block diagram illustrating an application scenario of the electronic device depicted in FIG. 25 according to an embodiment of the disclosure.

FIG. 27 is a block diagram illustrating an application scenario of the electronic device 100 depicted in FIG. 25 according to an embodiment of the disclosure. Referring to FIG. 25 and FIG. 27, the communication module 1430 of the electronic device 100 includes the wireless communication capability for connecting the Internet 2720. For example, the communication module 1430 may include a wireless local area network (WLAN) circuit such as a Wi-Fi circuit, a ZigBee circuit, a Bluetooth circuit, a radio frequency identification (RFID) circuit, a Near Field Communication (NFC) circuit or other wireless communication circuits. Accordingly, the electronic device 100 is capable of establishing a connection with a remote device 2710 via the Internet 2720. The remote device 2710 may be a remote server (e.g. an entertainment content server, a file server, a social network server, etc.), a personal computer, a mobile device (e.g. a tablet computer, a smart phone), or other electronic devices. In some embodiments, through the communication module 1430 and the control unit 210 of the electronic device 100, the remote device 2710 may control the operating unit 220 to set the perceivable content. The control unit 210 may record the perceivable content set by the remote device 2710 into the memory 2520. For instance, the control unit 210 may receive the external data provided by the remote device 2710 via the communication module 1430, and record the external data into the memory 2520. The control unit 210 may determine the perceivable content presented by the presentation module 1420 according to the external data. The external data may include, for example, the music data, the lighting display data, the command, the script or the other data.

In another embodiment, the control unit 210 may transmit an outside physical characteristic (e.g. an ambient brightness, an ambient sound, the touch gesture on the presentation unit 110, the movement of the electronic device 100, etc.) detected by the operating unit 220 via the communication module 1430 and the Internet 2720 to the remote device 2710. The remote device 2710 may provide a corresponding external data according to the outside physical characteristic to the communication module 1430 of the electronic device 100 to control the perceivable content presented by the presentation module 1420.

Figure 28:
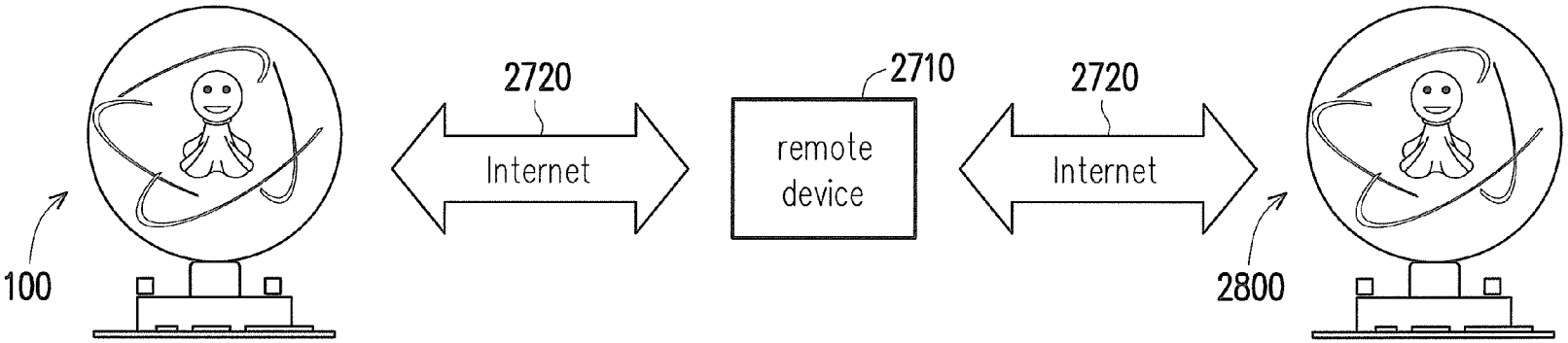
FIG. 28 is a block diagram illustrating an application scenario of the electronic device depicted in FIG. 25 according to another embodiment of the disclosure.

FIG. 28 is a block diagram illustrating an application scenario of the electronic device 100 depicted in FIG. 25 according to another embodiment of the disclosure. The embodiment depicted in FIG. 28 may be inferred by reference with related description for FIG. 27. Implementation details regarding an electronic devices 2800 depicted in FIG. 28 may be inferred by reference with related description for the electronic device 100. Referring to FIG. 25 and FIG. 28, the electronic device 100 may establish a connection with the electronic device 2800 via the remote device 2710, wherein the electronic device 2800 may be remote from the electronic device 100. Accordingly, the electronic device 100 and the electronic device 2800 may, for example, be remote interactive crystal balls. The electronic device 100 and the electronic device 2800 may share crystal ball information and media information (e.g. the perceivable content) with each other.

In an embodiment, the user may control the electronic device 2800 by operating the electronic device 100. For example, the electronic device 100 and the electronic device 2800 may present the identical or similar perceivable content synchronously. As another example, a user A may play the electronic device 100, and the electronic device 100 may record a play history of played by the user A, and upload the play history to the remote device 2710. The electronic device 2800 of a user B may download the play history of the electronic device 100 from the remote device 2710 for presentation. Accordingly, the user A may share the play history to the user B who is remote from the user A.

In another embodiment, the electronic device 2800 may upload the external events or signals detected by the sensor therein to the remote device 2710. The remote device 2710 may download the external events or signals detected by the electronic device 2800 to the electronic device 100, and vice versa. Therefore, the user A operating the electronic device 100 and the user B operating the electronic device 2800 may conduct an interactive entertainment in real time.

In summary, an electronic device is disclosed according to above embodiments of the disclosure, and the electronic device is capable of presenting the perceivable content in the manner of sound or light, and communicating with the external electronic devices. In some other embodiments, the electronic device may communicate with another external electronic device to perform the instrumental ensemble or the chorus together. The electronic device may be applied in the interactive electronic device, such as an interactive crystal ball (water globes, or snow globes), an interactive toy, an interactive toy musical instrument (e.g. a saxophone, a trumpet, a drum, a piano, and singers of the duet), an interactive model or other electronic devices capable of presenting the perceivable content. However, the possible implementations of the disclosure are not limited to the above.

Although the disclosure has been described with reference to the above embodiments, it is apparent to one of the ordinary skill in the art that modifications to the described embodiments may be made without departing from the spirit of the disclosure. Accordingly, the scope of the disclosure will be defined by the attached claims not by the above detailed descriptions.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electronic device for presenting perceivable content, adapted to perform at least one of an instrumental ensemble, a chorus and a dance together with an external electronic device, and the electronic device comprising:

a presentation unit;

an operating unit, disposed to present a first part of the perceivable content on the presentation unit, and communicate with the external electronic device by a manner of a sound or a light of the first part of the perceivable content, wherein a synchronous data is embedded in the sound or the light of the perceivable content; and a control unit, electrically coupled to the operating unit, disposed to control the operating unit for presenting the perceivable content, wherein the external electronic device collaboratively presents a second part of the perceivable content together with the electronic device according to the synchronous data, the first part of the perceivable content and the second part of the perceivable content are different, the external electronic device performs at least one of the instrumental ensemble, the chorus and the dance together with the electronic device according to the synchronous data, and the synchronous data comprises a timestamp, an elapsed time, or a musical note.

2. The electronic device for presenting perceivable content of claim 1, wherein the presentation unit comprises at least one of a sphere, a musical instrument, a music box, a doll, a toy and a model.

3. The electronic device for presenting perceivable content of claim 1, wherein the electronic device for presenting perceivable content further comprises a base, the presentation unit is disposed on the base, the operating unit is disposed to present the perceivable content on the presentation unit by the manner of the sound or the light, the presentation unit has a transparent space, and the transparent space is a crystal ball.

4. The electronic device for presenting perceivable content of claim 3, wherein the operating unit comprises:

an animation display module, electrically coupled to the control unit, wherein the animation display module is disposed in the transparent space of the presentation unit, and the animation display module projects an animation on a surface of the presentation unit according to the control of the control unit in order to present the perceivable content.

5. The electronic device for presenting perceivable content of claim 1, wherein the presentation unit comprises a model, wherein when the model is a musical instrument model, the perceivable content comprises a musical instrument sound corresponding to the musical instrument model, and when the model is a doll or a toy, the doll or the toy are disposed to dance in correspondence to the perceivable content under the control of the control unit.

6. The electronic device for presenting perceivable content of claim 1, wherein the operating unit comprises:

a sensing module, electrically coupled to the control unit, wherein the control unit detects or receives an external event or signal via the sensing module; and a presentation module, electrically coupled to the control unit, wherein the control unit presents the perceivable content on the presentation unit by the manner of the sound or the light via the presentation module, and communicates with the external electronic device by the manner of the sound or the light via the presentation module.

7. The electronic device for presenting perceivable content of claim 6, wherein the sensing module comprises at least one of a microphone, a g-sensor, a mercury switch and a photo sensor, and the presentation module comprises at least one of a speaker, a lamp, a motor and a smell generator.

8. The electronic device for presenting perceivable content of claim 7, wherein when the control unit receives an information corresponding to an external signal via the sensing module, according to at least one of a strength, a scale and a rhythm of the external signal, the control unit correspondingly controls a rotating speed of the motor, or correspondingly controls at least one of a color, a flickering frequency and a brightness of the lamp, or correspondingly controls a volume of the speaker, or correspondingly controls a smell generated by the smell generator;

when the control unit receives an information corresponding to a movement of the electronic device via the sensing module, according to the movement of the electronic device, the control unit correspondingly controls the rotating speed of the motor, or correspondingly controls at least one of the color, the flickering frequency and the brightness of the lamp, or correspondingly controls the volume of the speaker, or correspondingly controls the smell generated by the smell generator; and when the control unit receives an information corresponding to a touch event on the presentation unit via the sensing module, according to the touch event, the control unit correspondingly controls the rotating speed of the motor, or correspondingly controls at least one of the color, the flickering frequency and the brightness of the lamp, or correspondingly controls the volume of the speaker, or correspondingly controls the smell generated by the smell generator.

9. The electronic device for presenting perceivable content of claim 6, wherein the sensing module comprises:

a sound or light receiver, disposed to detect or receive the external event or signal and output a sensed signal;

a mixer, coupled to the sound or light receiver to receive the sensed signal, wherein the mixer down-converts the sensed signal into a baseband signal according to a carrier frequency;

a filter, coupled to the mixer to receive the baseband signal and output a filtered signal; and a decoder, coupled to the filter to receive the filtered signal and decode the filtered signal to obtain an external information contained in the external event or signal.

10. The electronic device for presenting perceivable content of claim 6, wherein the presentation module comprises:

a modulator, modulating sound or light data corresponding to the perceivable content according to a communication data to be transmitted to the external electronic device, and outputting modulated data;

a mixer, coupled to the modulator to receive the modulated data, wherein the mixer loads the modulated data on a carrier, and outputs a mixed signal;

a filter, coupled to the mixer to receive the mixed signal, and outputting a filtered signal; and a sound or light transmitter, coupled to the filter to receive the filtered signal, and emitting a sound or light to present the perceivable content according to the filtered signal, wherein the communication data are embedded in the sound or light.

11. The electronic device for presenting perceivable content of claim 1, wherein the control unit processes an external signal received by at least one of the operating unit and a communication module, and determines the perceivable content according to the external signal.

12. The electronic device for presenting perceivable content of claim 11, wherein the external signal comprises at least one of music data, lighting display data, a command and a script.

13. The electronic device for presenting perceivable content of claim 1, wherein the external electronic device is at least one of another electronic device for presenting perceivable content, a cell phone, a microprocessor, a computer, a notebook computer, a tablet computer and a server.

14. The electronic device for presenting perceivable content of claim 1, wherein the operating unit comprises:

a communication module, electrically coupled to the control unit, and the communication module having a wireless communication capability for communicating with an external electronic device or connecting to the Internet.

15. The electronic device for presenting perceivable content of claim 14, wherein a remote device controls the operating unit via the communication module and the control unit to set the perceivable content.

16. The electronic device for presenting perceivable content of claim 14, wherein the control unit transmits an outside physical characteristic detected by the operating unit to a remote device via the communication module, and the remote device provides a corresponding external data according to the outside physical characteristic to the communication module to control the perceivable content.

17. The electronic device for presenting perceivable content of claim 1, wherein the operating unit communicates with the external electronic device by transmitting a communication data which is unable for human to notice.

18. The electronic device for presenting perceivable content of claim 17, wherein the operating unit determines a total pulse-width of a sound or light within a period according to the perceivable content for a pulse-width modulation, and determines a number of pulses and a pulse phase within the period according to the communication data.

19. The electronic device for presenting perceivable content of claim 1, wherein when a stand-alone mode is entered, the electronic device for presenting perceivable content presents the perceivable content in a stand-alone manner; and when the stand-alone mode is not entered, the control unit transmits the perceivable content with a synchronous data via the operating unit.

20. The electronic device for presenting perceivable content of claim 1, wherein when a stand-alone mode is entered, the electronic device for presenting perceivable content presents the perceivable content in a stand-alone manner; and when the stand-alone mode is not entered, the electronic device for presenting perceivable content performs at least one of an instrumental ensemble, a chorus and a dance together with the external electronic device in a master-slave architecture, wherein two of the electronic device for presenting perceivable content and the external electronic device include one being a master device and another one being a slave device, and a signal synchronization or communication is performed between the electronic device for presenting perceivable content and the external electronic device by adopting a reliable mode or a non-reliable mode.

21. The electronic device for presenting perceivable content of claim 1, wherein the operating unit is disposed to present the first part of the perceivable content on the presentation unit by the manner of the sound or the light and to embed a data code which is to be transmitted to the external electronic device in the sound or the light of the first part of the perceivable content, wherein the control unit correspondingly decides a time shift quantity according to the data code, and the control unit controls the operating unit to shift a starting-point of a note in a sound content of the perceivable content or a light-up starting-point of the light in the perceivable content according to the time shift quantity so as to transmit the data code; or the control unit correspondingly decides a frequency shift quantity according to the data code, and the control unit controls the operating unit to shift a frequency of the note in the sound content of the perceivable content according to the frequency shift quantity so as to transmit the data code.

22. An electronic device for presenting perceivable content, adapted to perform at least one of an instrumental ensemble, a chorus and a dance together with an external electronic device, and the electronic device for presenting perceivable content comprising:

a control unit;

an operating unit, electrically coupled to the control unit, wherein the operating unit is disposed to present a perceivable content by a sound or a light according to a control of the control unit; and a communication module, electrically coupled to the control unit, and the communication module having a wireless communication capability for communicating with the external electronic device, wherein the control unit transmits a synchronous data to the external electronic device via the communication module, the external electronic device performs at least one of the instrumental ensemble, the chorus and the dance together with the electronic device according to the synchronous data, and the synchronous data comprise a timestamp, an elapsed time, or a musical note.

23. The electronic device for presenting perceivable content of claim 22, wherein the operating unit comprises:

a sensing module, electrically coupled to the control unit, wherein the control unit detects or receives an external event or signal via the sensing module; and a presentation module, electrically coupled to the control unit, wherein the control unit presents the perceivable content by a sound or a light via the presentation module.

24. The electronic device for presenting perceivable content of claim 23, wherein the sensing module senses a speed or a strength of at least one of a shaking, a pushing-pulling, a beating, a blowing, a palm-waving and an air commanding by various body parts, the control unit correspondingly controls at least one of a playback speed, a tune and a volume of the sound presented by the presentation module according to a sensing result of the sensing module.

25. The electronic device for presenting perceivable content of claim 22, wherein the external electronic device is at least one of another electronic device for presenting perceivable content, a cell phone, a microprocessor, a computer, a notebook computer, a tablet computer and a server.

26. The electronic device for presenting perceivable content of claim 22, wherein the control unit transmits a synchronous data of a music played by the operating unit to the external electronic device via the communication module, and the external electronic device starts to play an ensemble music corresponding to the synchronous data after receiving the synchronous data of the music.

27. The electronic device for presenting perceivable content of claim 26, wherein the synchronous data comprises at least one of a music number, the timestamp, a beacon, a paragraph, the elapsed time, the musical note, a starting trigger and an ending trigger.

28. The electronic device for presenting perceivable content of claim 22, wherein the control unit is capable of transmitting related data of a song to the external electronic device via the operating unit, and vice versa.

29. The electronic device for presenting perceivable content of claim 22, wherein when a stand-alone mode is entered, the electronic device for presenting perceivable content presents the perceivable content in a stand-alone manner; and when the stand-alone mode is not entered, the control unit transmits the perceivable content having a synchronous data via the operating unit.

30. The electronic device for presenting perceivable content of claim 22, wherein when a stand-alone mode is entered, the electronic device for presenting perceivable content presents the perceivable content in a stand-alone manner; and when the stand-alone mode is not entered, the electronic device for presenting perceivable content performs at least one of an instrumental ensemble, a chorus and a dance together with the external electronic device in a master-slave architecture, wherein two of the electronic device for presenting perceivable content and the external electronic device include one being a master device and another one being a slave device, and a signal synchronization or communication is performed between the electronic device for presenting perceivable content and the external electronic device by adopting a reliable mode or a non-reliable mode.

31. The electronic device for presenting perceivable content of claim 22, wherein the operating unit is disposed to transmit a data code to the external electronic device, wherein the control unit correspondingly decides a time shift quantity according to the data code, and the control unit controls the operating unit to shift a starting-point of a note in a sound content of the perceivable content or a light-up starting-point of the light in the perceivable content according to the time shift quantity so as to transmit the data code; or the control unit correspondingly decides a frequency shift quantity according to the data code, and the control unit controls the operating unit to shift a frequency of the note in the sound content of the perceivable content according to the frequency shift quantity so as to transmit the data code.

32. The electronic device for presenting perceivable content of claim 1, wherein the operating unit transmits an inquiry signal to the external electronic device, and the operating unit transmits the perceivable content with the synchronous data in response to receiving a response from the external electronic device within a waiting time.

33. The electronic device for presenting perceivable content of claim 22, wherein the control unit transmits an inquiry signal to the external electronic device via the communication module, and the control unit transmits the perceivable content with the synchronous data via the communication module in response to receiving a response from the external electronic device within a waiting time.

* * * * *